United States Patent [19]

Stohlquist

[11] Patent Number: 4,530,435

[45] Date of Patent: Jul. 23, 1985

[54] PACKAGING APPARATUS FOR STICK CONFECTIONS

[75] Inventor: Roger H. Stohlquist, Rockford, Ill.

[73] Assignee: APV Anderson Bros. Inc., Rockford, Ill.

[21] Appl. No.: 441,087

[22] Filed: Nov. 12, 1982

[51] Int. Cl.[3] ..... B07C 5/02; B07C 5/16

[52] U.S. Cl. ..... 209/592; 53/54; 53/143; 53/202; 53/544; 198/374; 198/504; 209/644; 209/936

[58] Field of Search ..... 209/551, 565, 592–596, 209/644, 912, 923, 925, 932, 933, 936; 53/54, 143, 202, 498, 502, 544, 594; 198/341, 374, 403, 408, 409, 420, 424, 432, 458, 462, 504, 654, 698, 699

[56] References Cited

U.S. PATENT DOCUMENTS

| | | | |
|---|---|---|---|
| 2,849,116 | 8/1958 | Fried, Jr. | 209/594 |
| 3,043,070 | 7/1962 | Cammack | 53/544 |
| 3,272,331 | 9/1966 | Thiele et al. | 209/592 X |
| 3,307,696 | 3/1967 | Sager | 209/912 X |
| 3,347,349 | 10/1967 | Carlson | 198/403 X |
| 3,368,673 | 2/1968 | Johnson | 209/596 |
| 3,412,843 | 11/1968 | Maulini | 198/420 X |
| 3,596,750 | 8/1971 | Hendon et al. | 198/504 |
| 4,004,400 | 1/1977 | Anderson et al. | 53/202 X |
| 4,067,433 | 1/1978 | Phipps | 198/374 |
| 4,101,020 | 7/1978 | Langen | 198/462 X |
| 4,130,480 | 12/1978 | Loewenthal | 209/644 X |
| 4,192,415 | 3/1980 | Krener et al. | 53/143 X |

*Primary Examiner*—Robert B. Reeves
*Assistant Examiner*—Edward M. Wacyra
*Attorney, Agent, or Firm*—Vernon J. Pillote

[57] ABSTRACT

A packaging apparatus for assembling wrapped stick confections from a multi-lane packaging machine into groups with the stick ends of the wrapped stick confections overlapping. The packaging apparatus comprises endless type first and second conveyors each having product pushers at uniformly spaced locations therealong for advancing stick confections crosswise of their length from a loading station sequentially past a weighing station and an ejecting station to a stacking station. Mechanism is provided at the loading station for feeding wrapped stick confections from the multi-lane wrapping machine into the pockets on first and second conveyors with the stick ends in juxtaposition. A weigh scale apparatus is provided at the weighing station and, when the total weight of the wrapped stick confections advanced by a transversely aligned pair of product pushers to the weigh scale apparatus is less than a predetermined value, the scale apparatus operates an apparatus to eject the stick confections advanced by that pair of transversely aligned pair of product pushers when they move past the ejecting station. The first and second conveyors have outlet end portions extending from the ejecting station to the stacking station with the product pushers arranged in transverse alignment to advance wrapped stick confections in opposed pairs and with their stick ends overlapping to the stacking station, and group forming mechanism is provided at the stacking station for assembling opposed pairs of wrapped stick confections from the first and second conveyors into groups comprising a plurality of pairs of wrapped stick confections.

21 Claims, 25 Drawing Figures

AIR
CR16
230
W
CR15a
S6
TD4a
CR16a
BXa
CR15
253
TD4
CR15b
270a
TD6b
TD6a
TD6
S7
270
270b
CR4c
TD1a
275
CR4
276
X
C1
235
CR6a
232
MS2
234
MS3
Y
W
MS1
PB5
CR5
PB6
CR5b
CR5a
CR6
CR6b
CR9
CR11b
239a
CS a
CR5c
CR9a
239b
CR16b
CR9b
CR10
CR17a
239c
242
239d
CR4g
CR17b
TD3
S1
239
CR4e
BS
PE4
CR4f
Y
BSa
CTRa.
CR17
239e
261
239f
CR18
PB7
CBc
161c
161b
PE6
B
TD4b
TD5
TD5a
TD5b
S8
251
51
S6
254
39
S7
281
188
S1
256
50
S8

PE
216
217
211
208
214
215
216a

PE
216
217
211
208
214
215

24
24
23
23
200
205
216
211
212
206
208
217
203
207
208
204

102
201
200
202
21
21
PE
217
216
207
208
204
203
208
203a
216a 20
20
205
216
217
201
208
216a
212
203a
203
207
206
102
209
210
204
200
202b
202
202a
22

214
208
PE
209
203
102
203a
210
205
207
204
201
200

PACKAGING APPARATUS FOR STICK CONFECTIONS

BACKGROUND OF THE INVENTION

Confection bars such as those made of ice cream, fudge, pudding, flavored ices and the like are commonly formed with stick handles in an intermittent type molding machine. The stick confections are discharged in groups from the molding machine into the inlet of a multi-lane wrapping machine such as disclosed in U.S. Pat. No. 3,045,405. The stick confections are wrapped as they are advanced through the multi-lane wrapping machine and the wrapped stick confections are discharged in groups with the stick ends oriented in the same direction. In order to reduce the overall size of the carton or box required for packaging the stick confections, it is desirable to arrange the stick confections with their stick ends overlapping. Stick confection stacking apparatus have heretofore been made in which one group of stick confections from the multi-lane wrapping machine are fed onto a first bar conveyor with the stick ends facing in one direction, and a succeeding group of articles from the multi-lane wrapping machine are inverted and fed onto a second bar conveyor paralleling the first bar conveyor in such a manner that the stick ends of the second group overlap the stick ends of the first group to form overlapping pairs. The two bar conveyors advance the stick confections in pairs to a stacker which feeds the overlapping pairs of stick confections onto an accumulator ramp to form a stack of paired stick confections. Groups of paired stick confections are then manually removed and counted by an operator and deposited in a box.

If one or more stick confections in a group of stick confections discharged from the wrapping machine is either underweight or missing, as may occur due to any of various malfunctions in the continuous molding machine and/or multi-lane wrapping machine, then the stack of stick confections formed by the prior bar stacker would either include some underweight stick confections or incomplete pairs of stick confections. The prior stick confection stacking apparatus required an operator or operators to count and remove groups of stick confections from the stack and place them in a box. However, it was difficult for the operator to detect and remove underweight stick confections and to insert and properly interleave another stick confection where one has been removed or was missing. Accordingly, the packages sometimes contained underweight stick confections, empty wrappers, or an insufficient number of stick confections, or stick confections in which some of the handles were not properly interleaved in pairs.

SUMMARY OF THE INVENTION

An important object of this invention is to provide a packaging apparatus adapted to receive groups of stick confections from a wrapping machine and which arranges the stick confections in pairs with their stick ends overlapping; detects when a stick confection in each pair is either underweight or missing and then stacks only pairs of stick confections of proper weight with their stick ends overlapping.

Another object of this invention is to provide a packaging apparatus in accordance with the foregoing object and which forms stacked pairs of stick confections into groups and then transfers the groups to a packaging station.

Accordingly, the present invention provides a packaging apparatus for assembling wrapped stick confections from a multi-lane packaging machine into groups with the stick ends of the wrapped stick confections overlapping. The packaging apparatus comprises endless type first and second conveyors each having product pushers at uniformly spaced locations therealong defining pockets between adjacent pushers for advancing stick confections crosswise of their length from a loading station sequentially past a weighing station and an ejecting station to a stacking station. The first and second conveyors have relatively parallel inlet portions and mechanism is provided for feeding wrapped stick confections from the multi-lane wrapping machine into the pockets on first and second conveyors with the stick ends in juxtaposition. A weigh scale apparatus is provided at the weighing station and the first and second conveyors have relatively parallel intermediate portions extending past the weigh scale with the product pushers on the intermediate portions of the first and second conveyors arranged in transverse alignment to advance wrapped stick confections in opposed pairs to and away from the weigh scale. Ejector means is provided at the ejector station adapted when operated to eject wrapped stick confections from both the first and second conveyors and means responsive to the weigh scale means and operative when the total weight of the wrapped stick confections advanced by a transversely aligned pair of product pushers to the weigh scale means is less than a predetermined value is provided for operating the ejector means to eject the stick confections advanced by that pair of transversely aligned pair of product pushers when they move past the ejector station. The first and second conveyors have outlet end portions extending from the ejector station to the stacking station with the product pushers arranged in transverse alignment to advance wrapped stick confections in opposed pairs and with their stick ends overlapping to the stacking station, and group forming means is provided at the stacking station for assembling opposed pairs of wrapped stick confections from the first and second conveyors into groups comprising a plurality of pairs of wrapped stick confections.

These, together with other objects, features and advantages of this invention will be more readily understood by reference to the following detailed description, when taken in connection with the accompanying drawings wherein.

Figure 1:
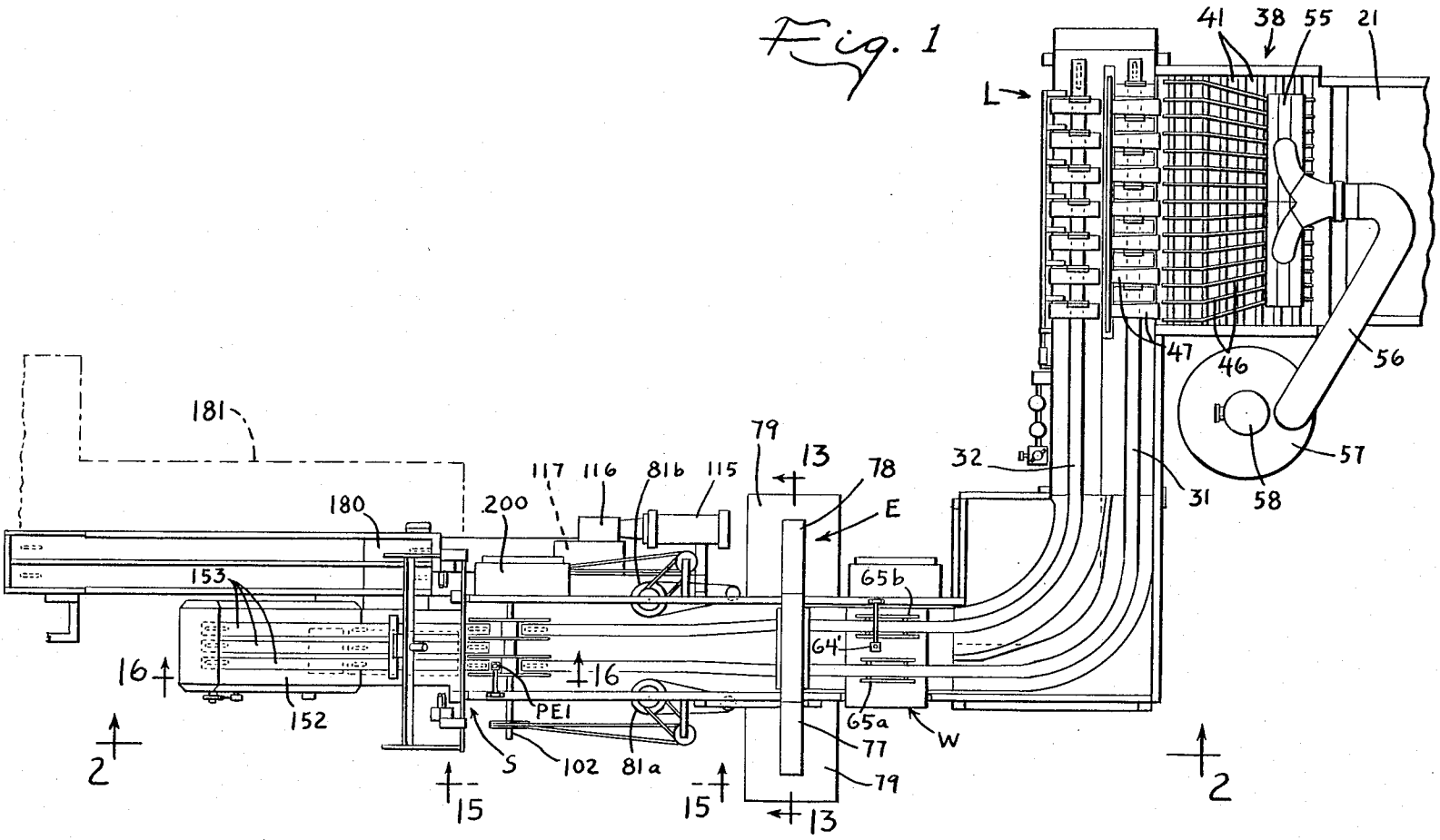
FIG. 1 is a top plan view of the packaging apparatus.
Figures 2, 3, 4:
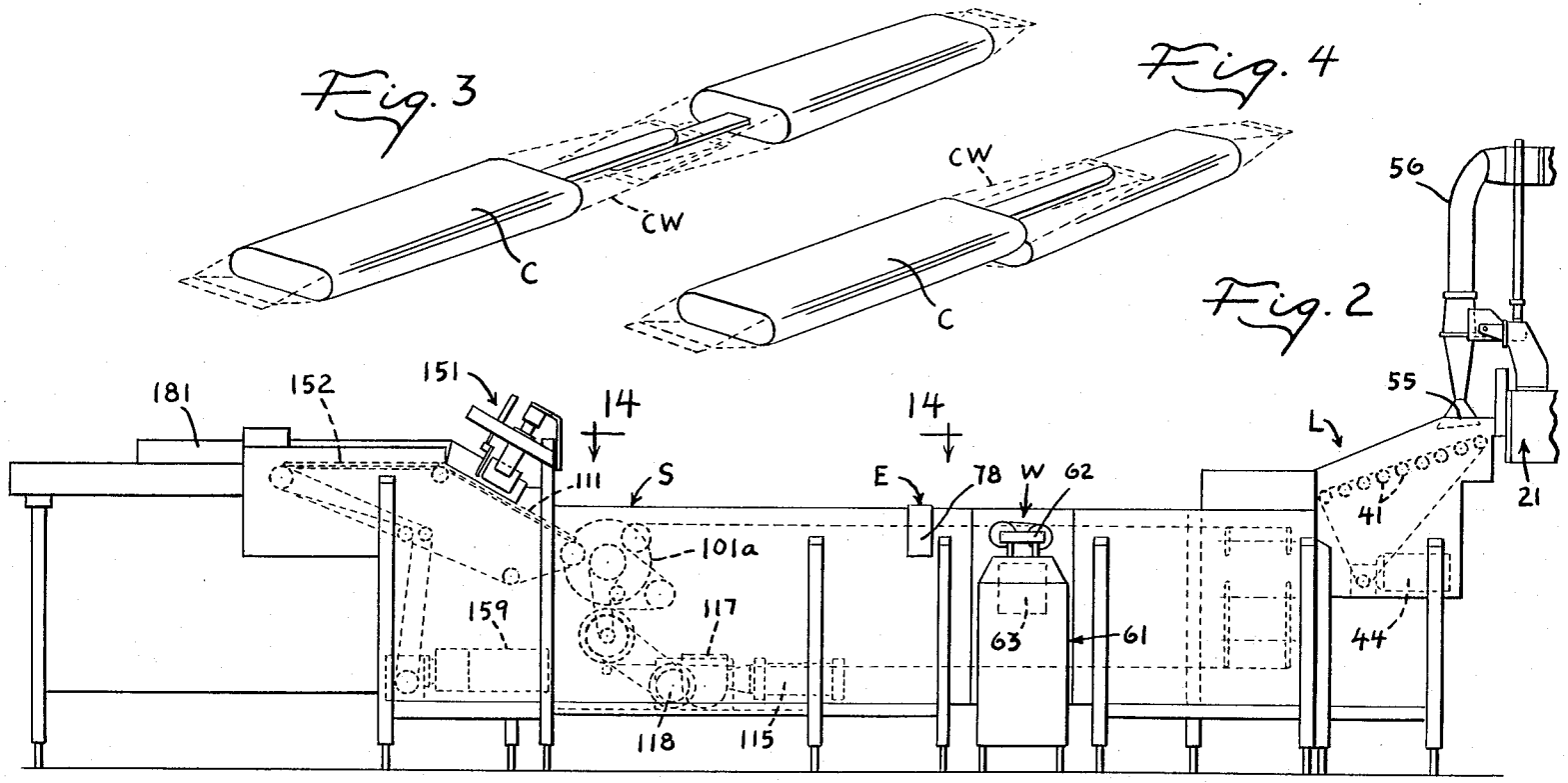
FIG. 2 is a side elevational view taken on the plane 2—2 of FIG. 1.
FIGS. 3 and 4 are perspective views of pairs of wrapped stick confections with their stick ends in varying degrees of overlap.
Figure 5:
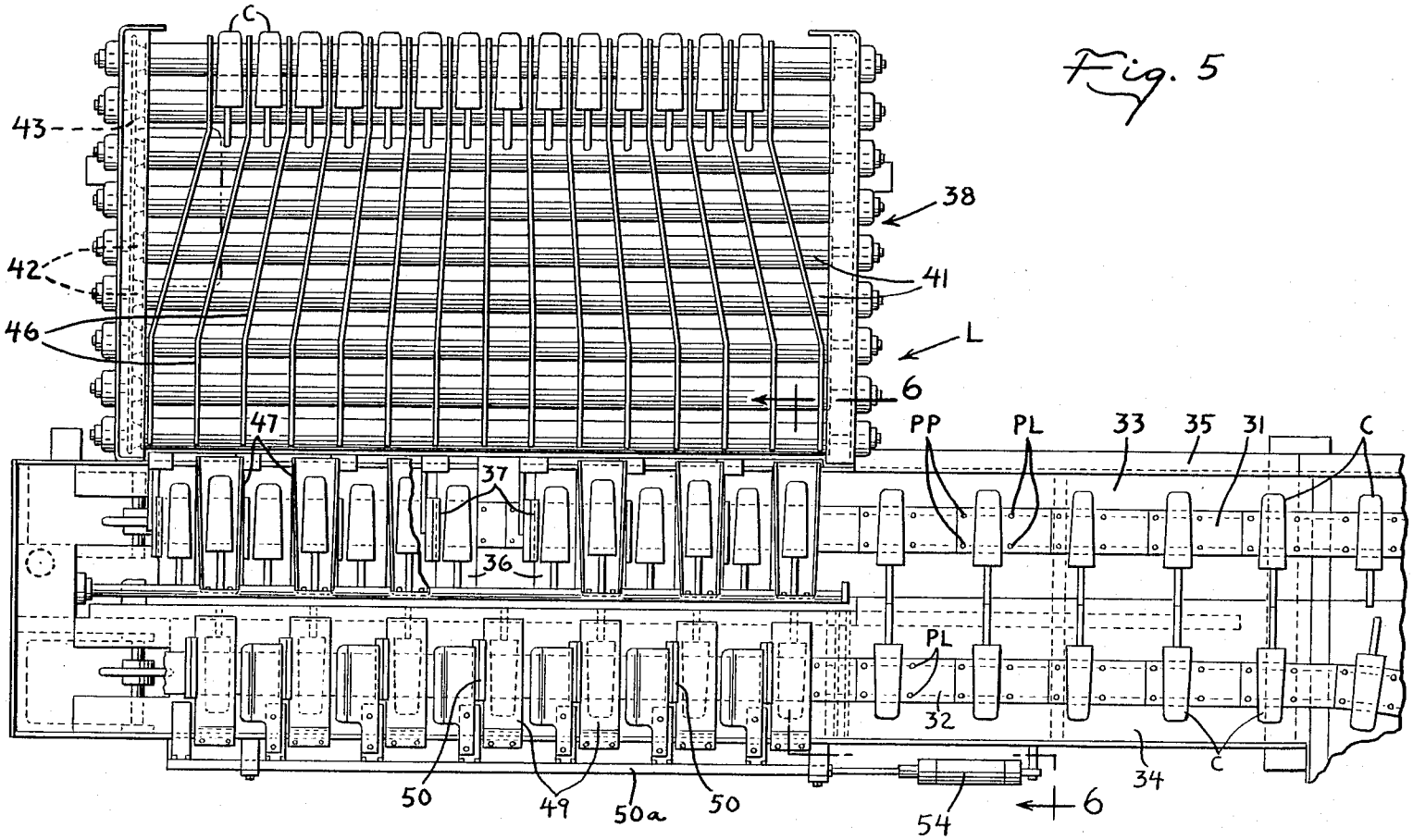
FIG. 5 is a plan view of the inlet portion of the packaging apparatus illustrating the parts on a larger scale than FIG. 1.
Figure 10:
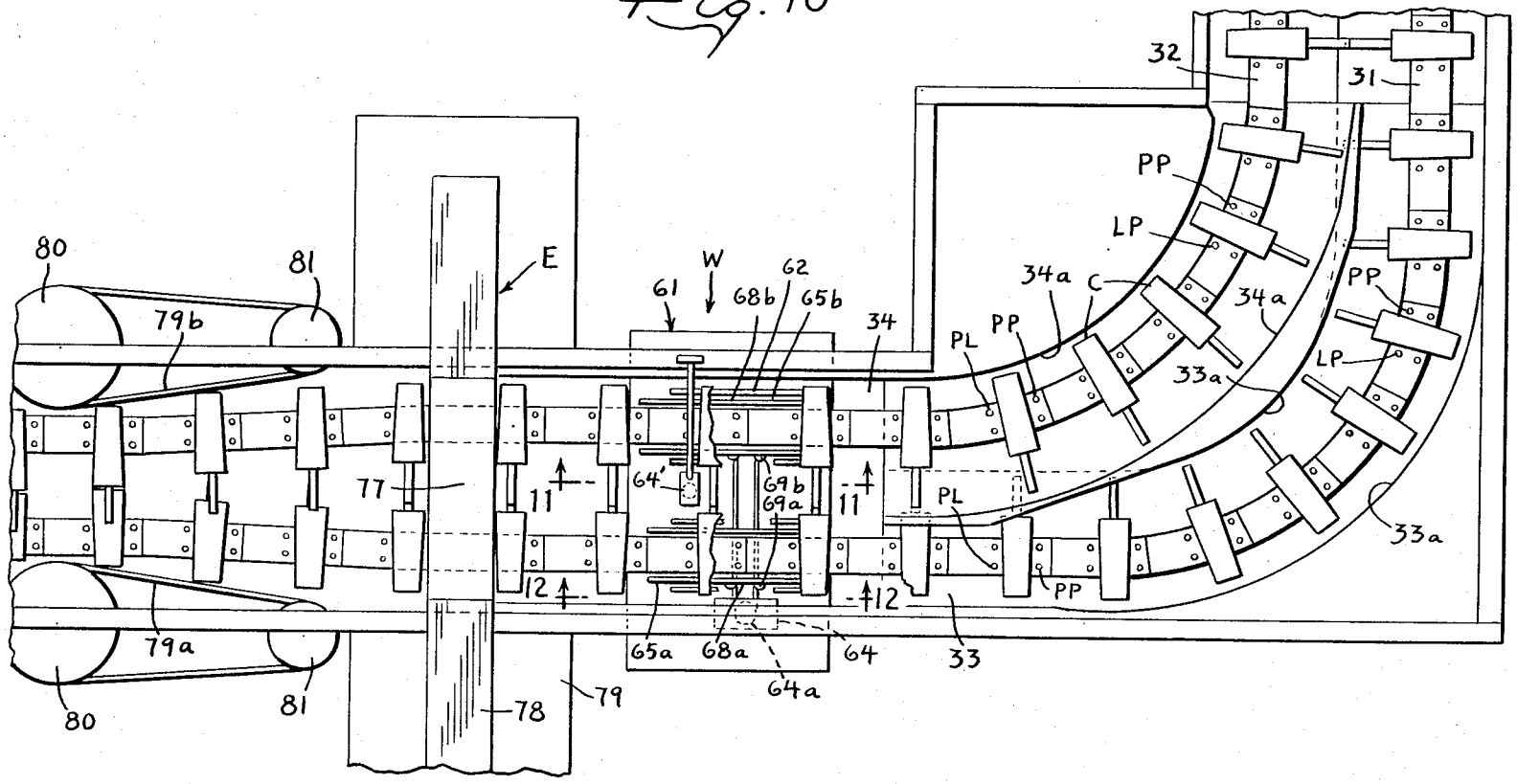
FIG. 10 is a plan view of an intermediate portion of the packaging machine illustrating the parts on a larger scale than FIG. 1.
Figure 11:
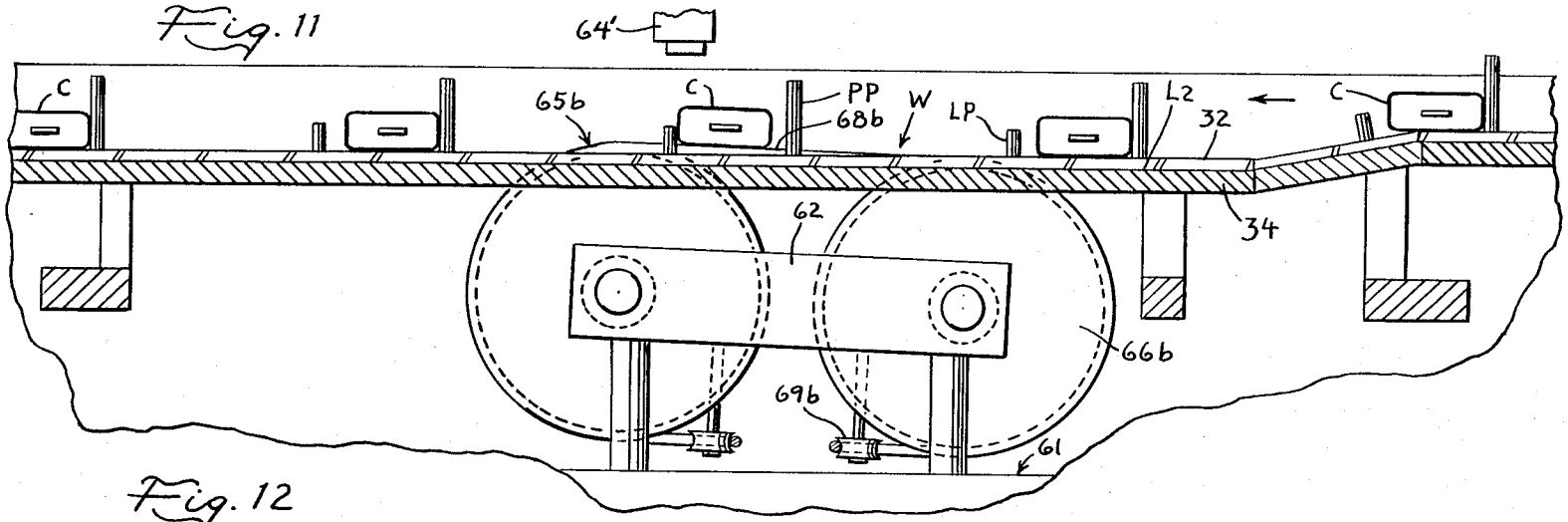
Figure 12:
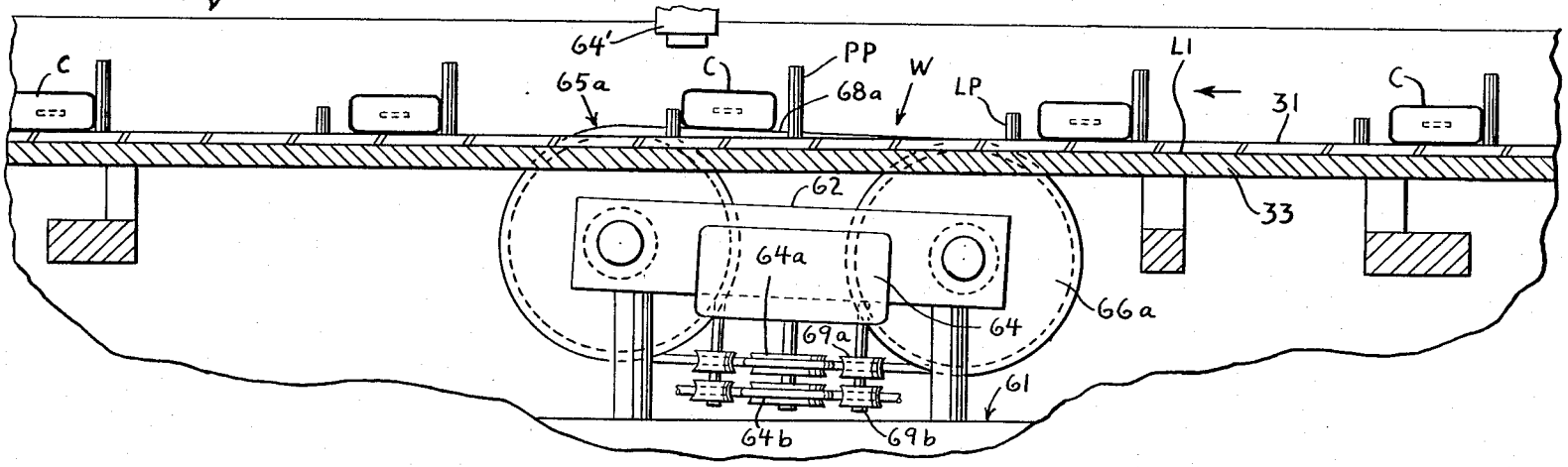
Figure 13:
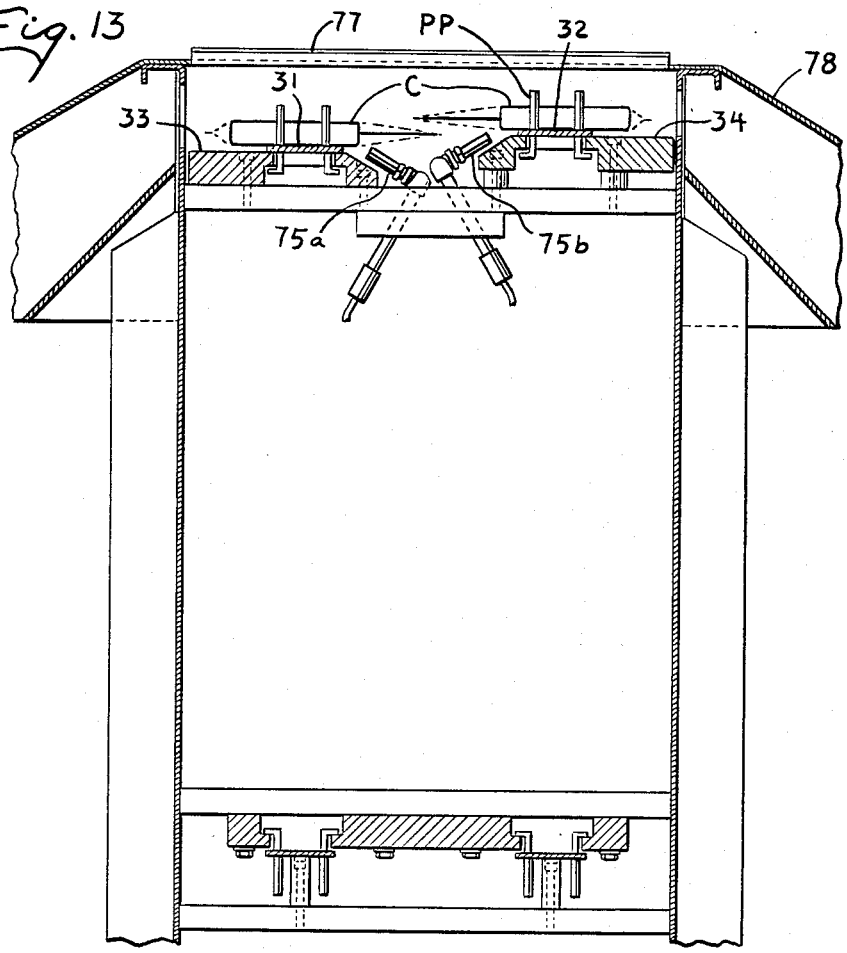
Figure 17:
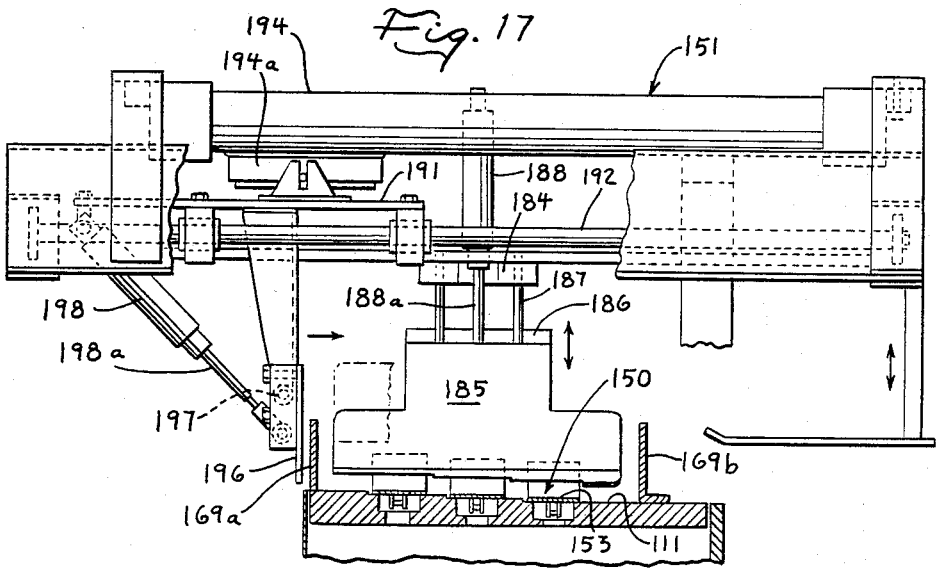
Figure 14:
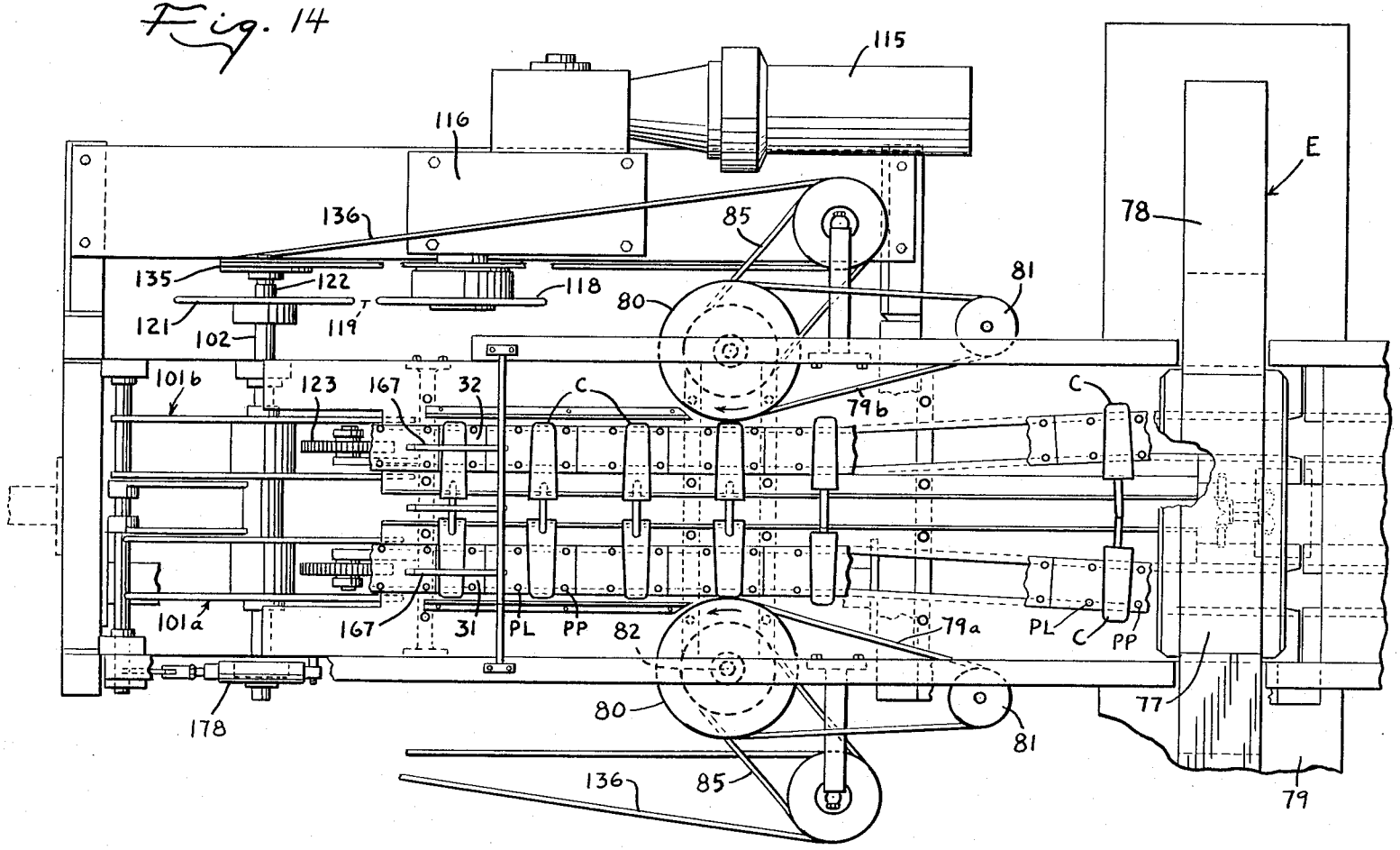
Figure 15:
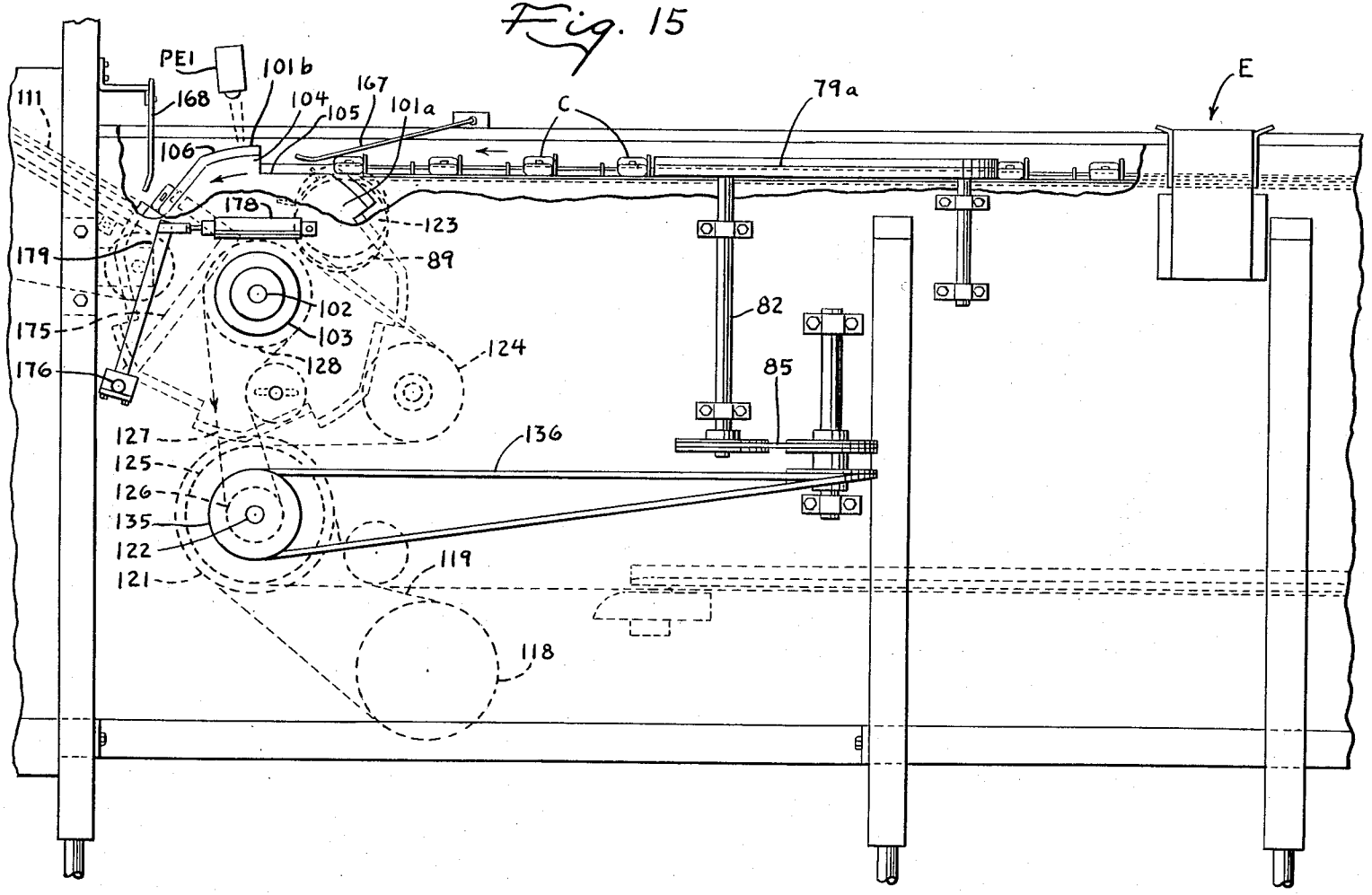
Figure 16:
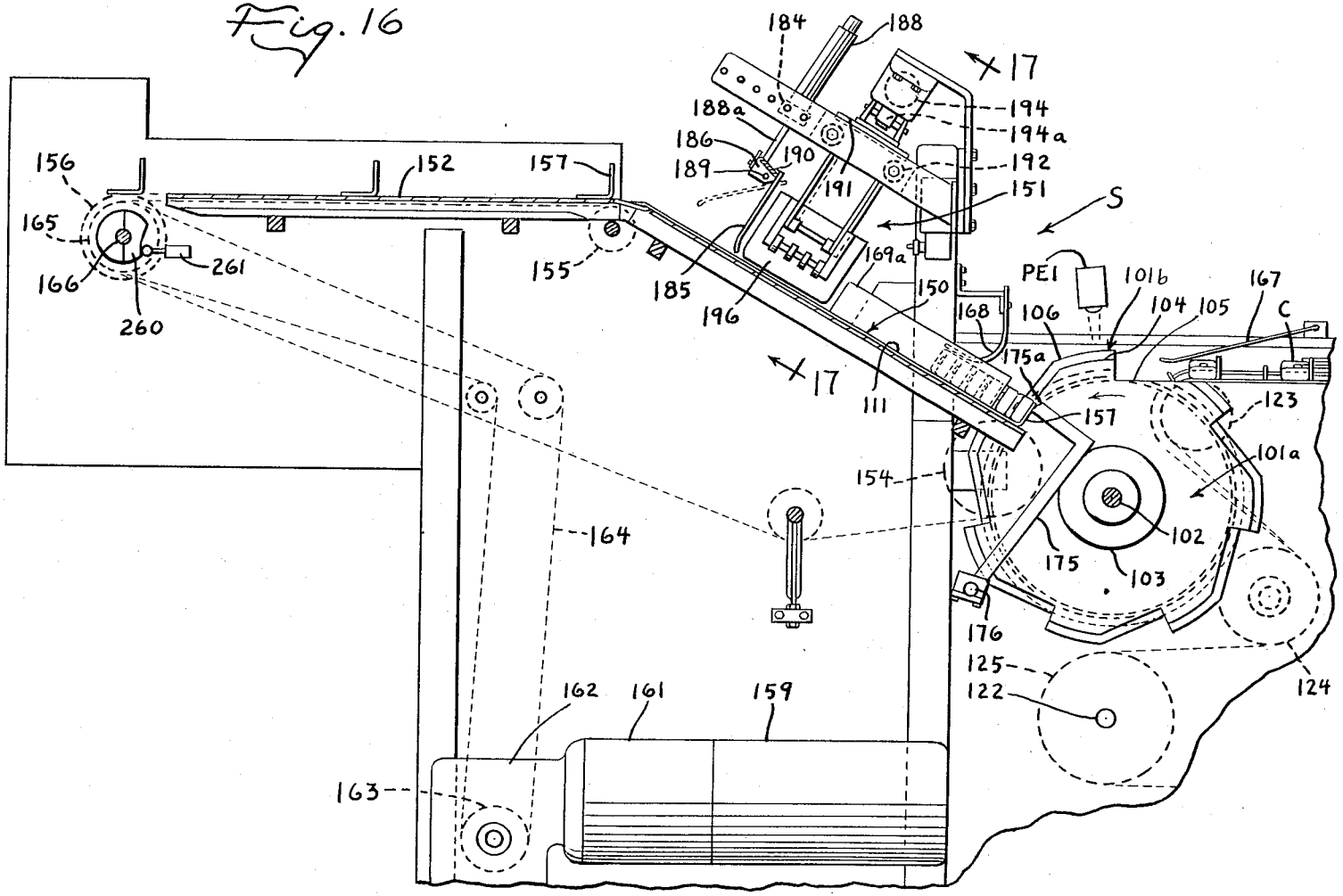
Figure 18A:
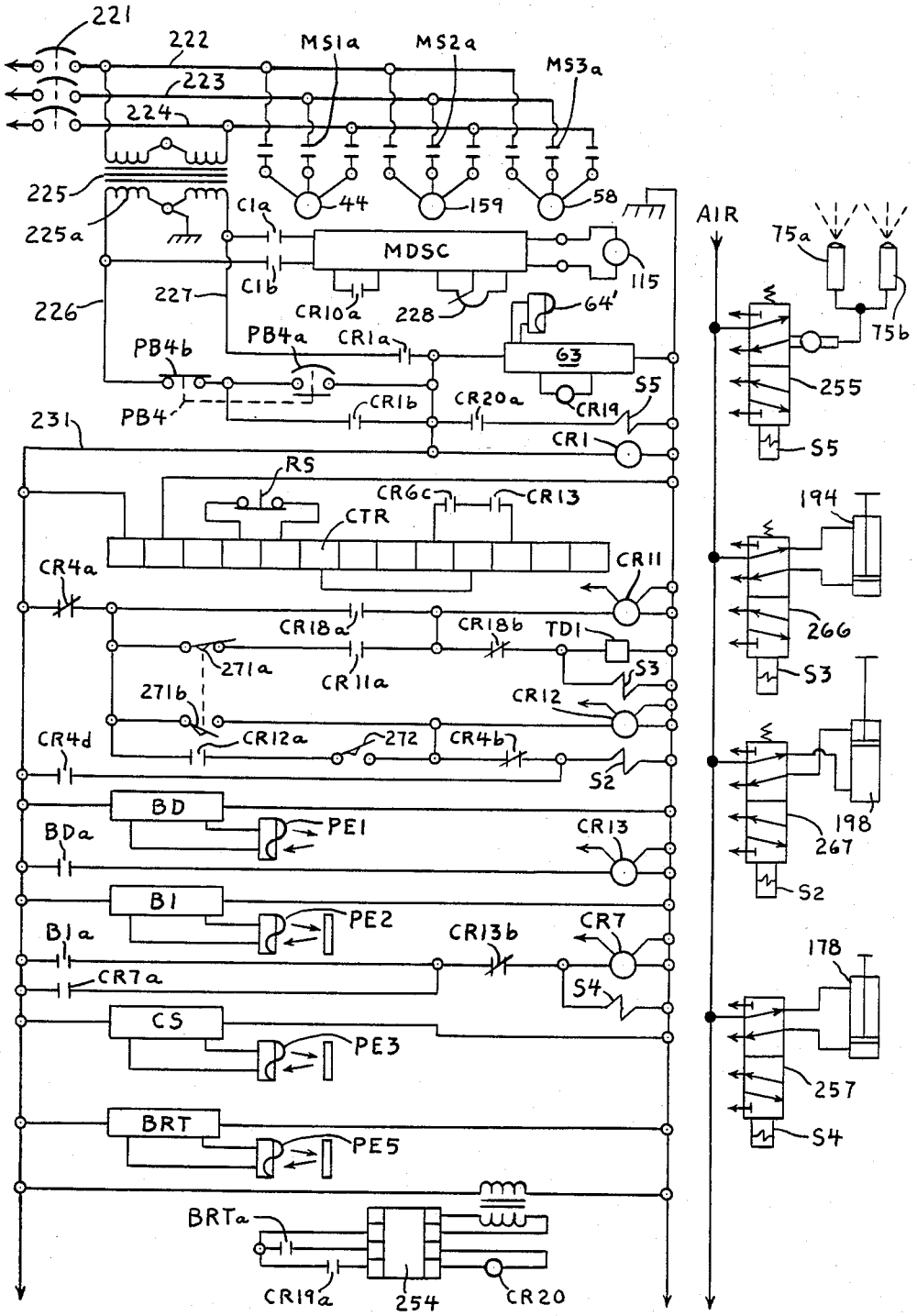
Figure 18B:
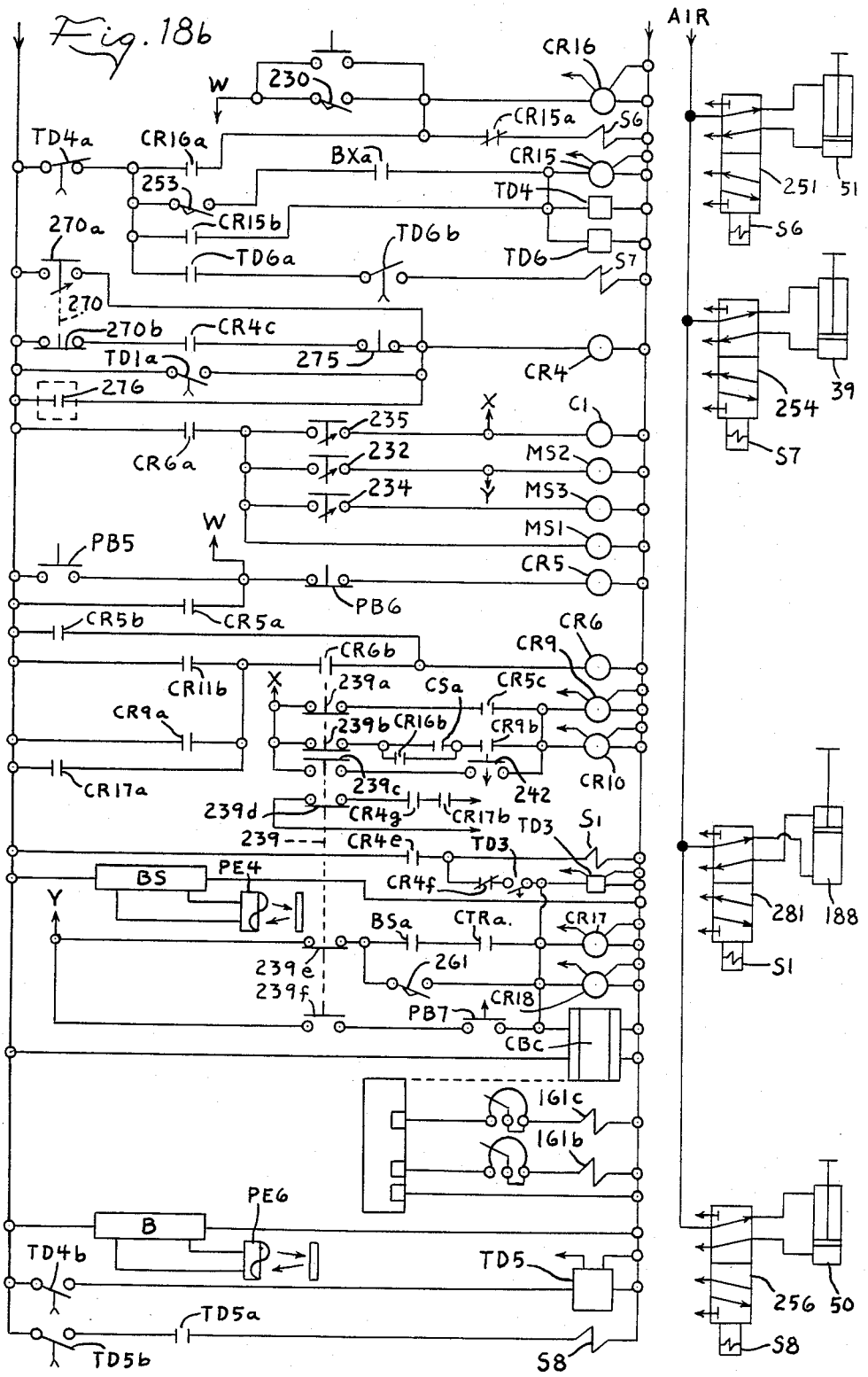
Figures 19, 20, 21, 22, 23, 24:
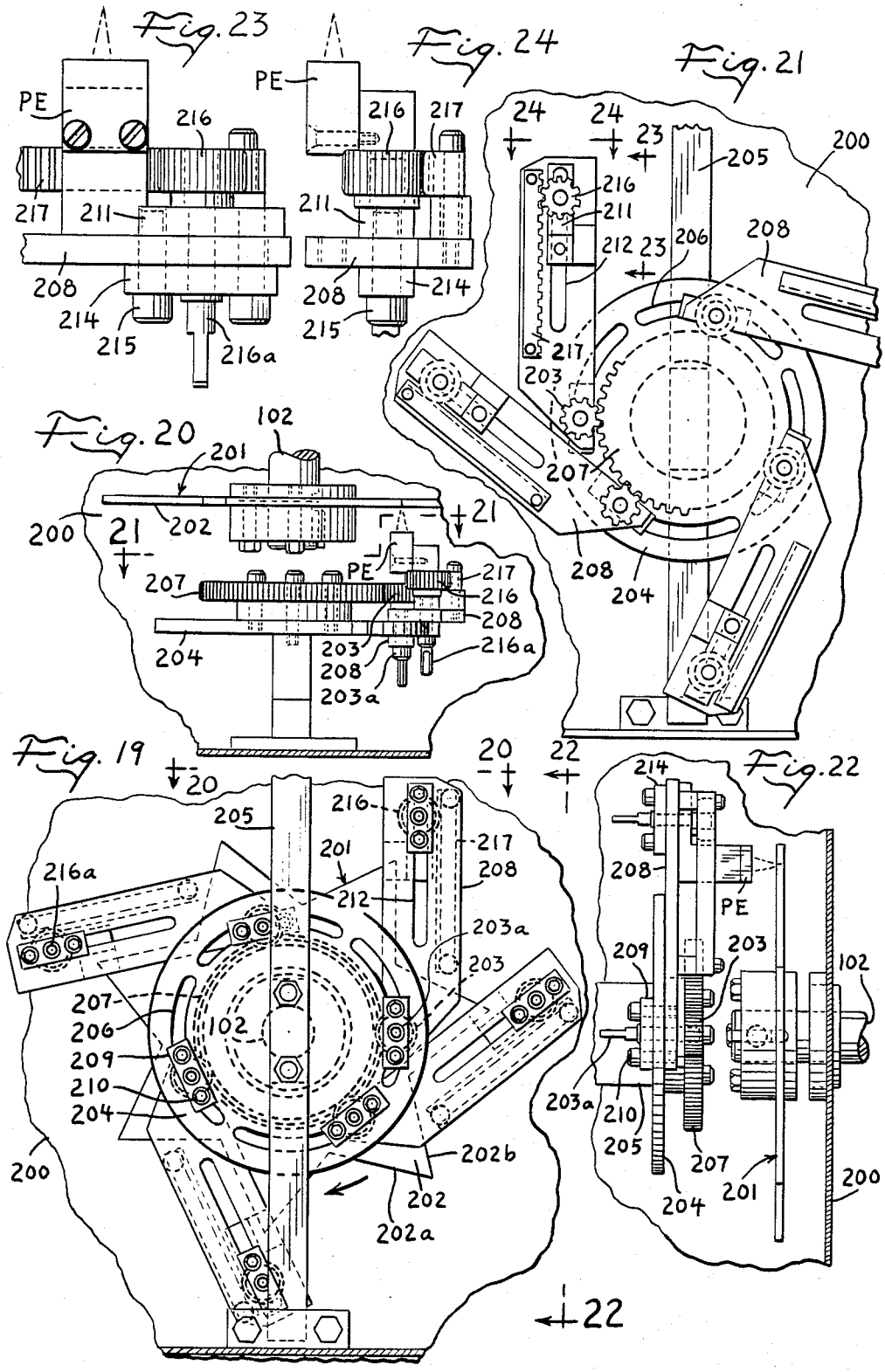

FIGS. 11 and 12 are vertical sectional views through the weigh mechanism taken on the planes 11—11 and 12—12 of FIG. 10;

FIG. 13 is a vertical sectional view through the ejector mechanism taken on the plane 13—13 of FIG. 1;

FIG. 14 is a fragmentary plan view of a portion of the apparatus taken on the plane 14—14 of FIG. 2 and illustrating parts on a larger scale;

FIG. 15 is a fragmentary side elevational view taken on the plane 15—15 of FIG. 1;

FIG. 16 is a fragmentary vertical sectional view taken on the plane 16—16 of FIG. 1;

FIG. 17 is a fragmentary transverse sectional view taken on the plane 17—17 of FIG. 16;

FIGS. 18*a* and 18*b* are schematic electrical and pneumatic diagrams illustrating the controls for the packaging apparatus;

FIG. 19 is a front view of a timing mechanism;

FIG. 20 is a fragmentary view taken on the plane 20—20 of FIG. 19;

FIG. 21 is a fragmentary view taken on the plane 21—21 of FIG. 20;

FIG. 22 is a fragmentary sectional view taken on the plane 22—22 of FIG. 19;

FIG. 23 is a fragmentary view taken on the plane 23—23 of FIG. 21 and illustrating parts on a larger scale;

FIG. 24 is a fragmentary view taken on the plane 24—24 of FIG. 21 and illustrating parts on a larger scale.

The present invention is adapted for use in packaging confection bars such as those made of ice cream, fudge, puddings, flavored ices and the like that are formed with a stick handle, hereinafter generally referred to as stick confections and designated by the letter C in FIGS. 3 and 4. Such stick confections are formed on an intermittent motion molding machine that discharges the stick confections in groups into a multi-lane wrapping machine such as disclosed in U.S. Pat. No. 3,045,405. The multi-lane wrapping machine operates to wrap the groups pf confections in a wrapper such as shown in dash lines in FIGS. 3 and 4 and designated by the letters CW, and intermittently discharge groups of the wrapped stick confections with the stick ends facing in the same direction. The number of lanes in the multi-lane wrapping machine in general corresponds to the number of lanes in the continuous molding machine and, in the embodiment illustrated, the packaging machine is adapted for use with a multi-lane wrapping machine designated generally by the numeral 21 (FIGS. 1 and 2), having 14 lanes. The wrapping machine may be of the type disclosed in the aforementioned U.S. Pat. No. 3,045,405, to which reference is hereby made for a more complete description of the construction and operation of the wrapping machine.

The packaging apparatus includes endless type first and second conveyors 31 and 32 each having product pushers PP at uniformly spaced locations therealong and which define pockets between adjacent pushers for advancing the stick confections crosswise of their length from a loading station L sequentially past a weighing station W and ejecting station E to a stacking and grouping station S. The endless conveyors 31 and 32 are preferably of the plate type in which a plurality of plates are pivotally interconnected to provide a continuous but flexible supporting surface, and the product pushers PP are mounted on spaced ones of the plates at spaced locations therealong to define pockets between the adjacent product pushers. For reasons pointed out hereinafter, the plate type conveyors 31 and 32 are also preferably of the type that have limited lateral flexibility, to allow the plate type conveyors to traverse curves. The upper run of the conveyor 31 is supported on conveyor guide members 33 that define a trackway therebetween, and the upper run of the conveyor 32 is similarly supported on spaced conveyor guide members 34 that define a trackway therebetween. Conveyor guide members 33 and 34 vertically and laterally guide the upper runs of the conveyors 31 and 32 past the several stations.

Figure 6:
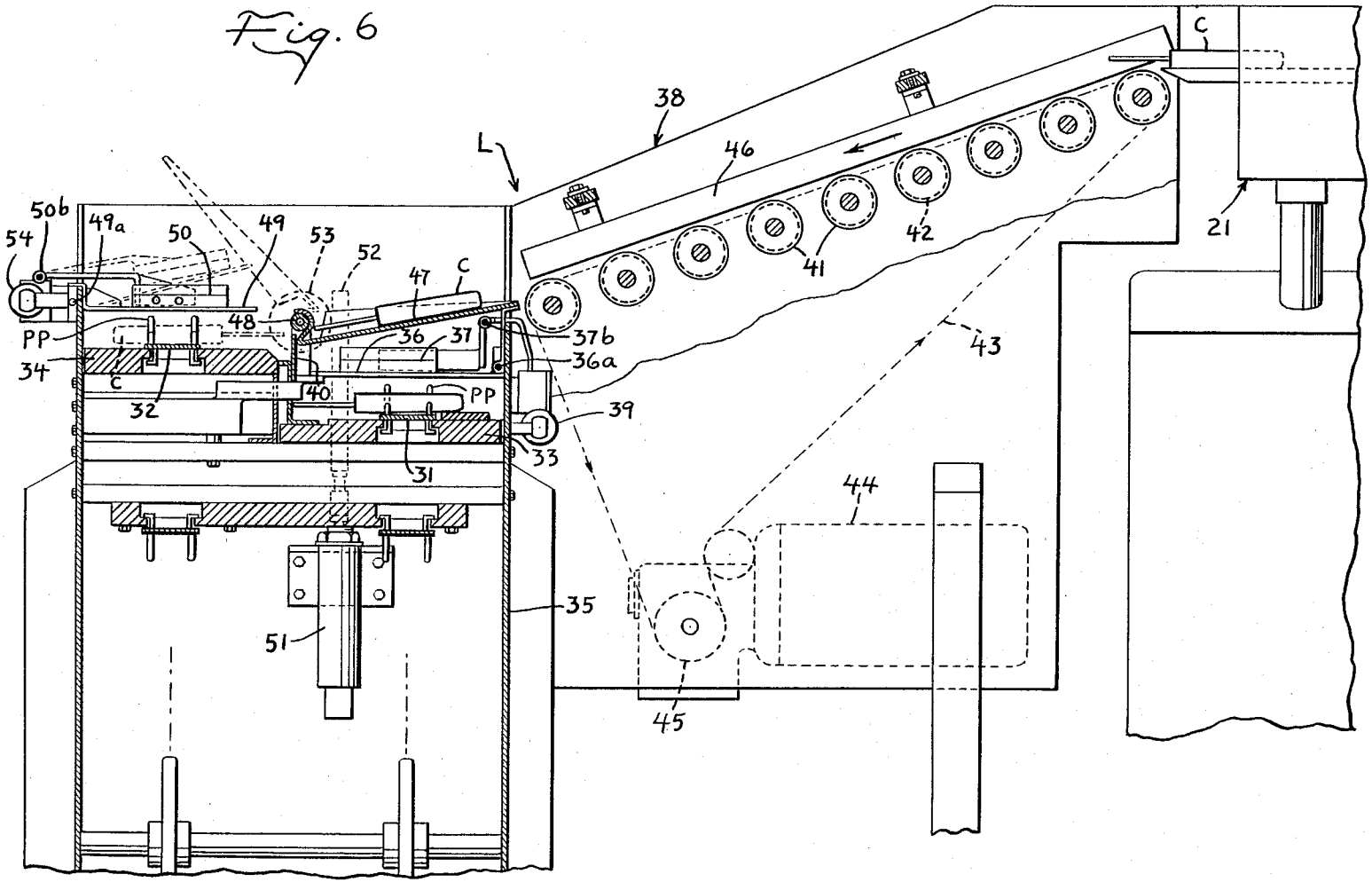
FIG. 6 is a transverse sectional view taken on the plane 6—6 of FIG. 5.
Figure 7:
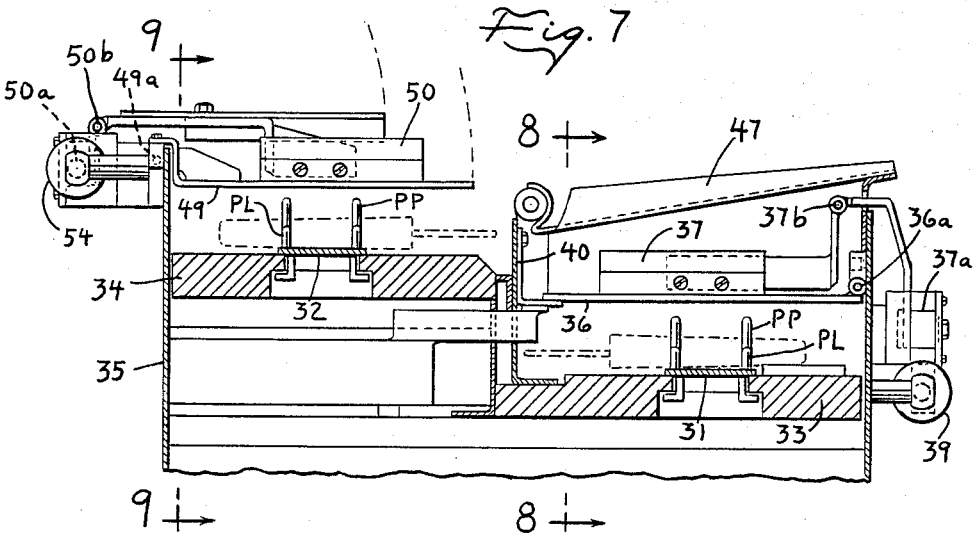
FIG. 7 is a fragmentary transverse vertical sectional view taken on the plane 6—6 of FIG. 5 and showing parts on a larger scale.
Figure 8:
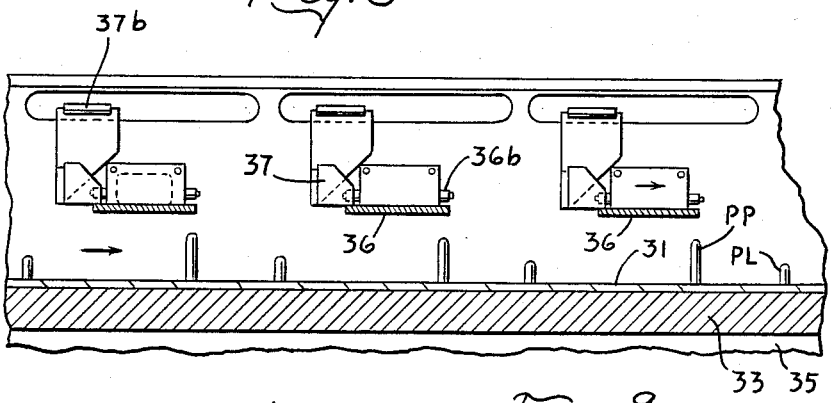
FIG. 8 is a fragmentary sectional view taken on the plane 8—8 of FIG. 7.
Figure 9:
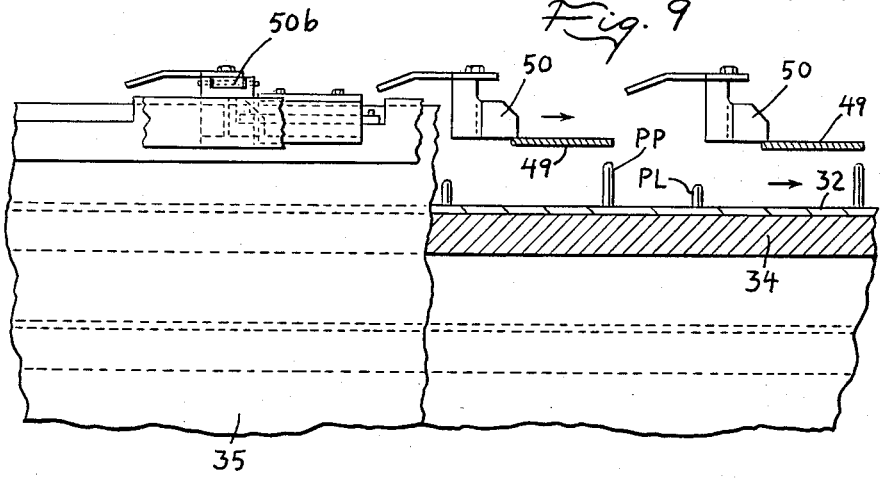
FIG. 9 is a fragmentary sectional view taken on the plane 9—9 of FIG. 7.

The first and second conveyors have relatively parallel inlet portions at the loading station L that extend crosswise of the path of movement of the wrapped stick confections as they are discharged from the wrapping machine 21. As best shown in FIGS. 6 and 7, the conveyor guide members 33 and 34 at the loading station are mounted on a support structure 35 and arranged to support the upper run of the inlet portion of the conveyor 32 at a level above the upper run of the inlet portion of the conveyor 31, and with the inlet portions of the conveyors 31 and 32 also horizontally offset. The stick confections are discharged from the wrapping machine 21 in groups on closely spaced centers with their stick ends leading during advance from the wrapping machine. An inlet feed mechanism 38 is provided for feeding the group of stick confections from the outlet of the wrapping machine into the pockets on the first and second endless conveyors 31 and 32, with the stick ends in juxtaposition, that is with the stick ends on the adjacent ends of the stick confections on the first and second conveyors. For reasons pointed out hereinafter, the feed and inverting mechanism is also arranged to increase the spacing between the stick confections on the conveyors so that the stick confections are spaced apart on the conveyors a distance that is large as compared to the transverse width of the stick confections, for example of the order of six inches, to facilitate weighing at the weigh station.

The inlet feed mechanism 38 includes an accelerator table comprising a plurality of infeed rollers 41 disposed in a downwardly inclined plane and mounted for axial rotation about an axis crosswise of the path of the stick confections. The infeed rollers 41 have sprockets 42 at one end and, as shown in FIG. 6, are driven as by a chain 43 from a motor 44 having an output drive sprocket 45. The chain 43 extends from the drive sprocket 45 over the tops of the sprockets 42 on the rollers 41 and drives all the rollers at the same speed and in a direction indicated by the arrow in FIG. 6 to advance the stick confections downwardly along the tops of the rollers. Lateral guides 46 are supported by brackets over the top of the infeed rollers and the guides 46 diverge relative to each other to increase the spacing of the stick confections from the two and one-half inch spacing of the stick confections at the outlet of the wrapper to a three inch spacing at the outlet of the accelerator table. As shown in FIGS. 1 and 2, a hood 55 is mounted over the accelerator table and connected through a duct 56 to vacuum apparatus 57 having a drive motor 58. The vacuum apparatus is arranged to vacuum off or remove any empty wrappers in the groups of wrapped stick confections as they are advanced by the accelerator table.

In order to further increase the spacing between the stick confections on the conveyors, one group of alternate ones of the stick confections are deposited on the conveyor 31 and another group comprising the other alternate ones of the stick confection are deposited on the conveyor 32. For this purpose, a plurality of inverter trays 47 corresponding in number to one-half the number of lanes in the wrapping machine, are mounted on a shaft 48 at locations spaced therealong to align with alternate ones of the outlets between the lateral guides 46. The inverter trays are movable from a bar receiving position shown in solid lines in FIGS. 6 and 7, in which they are positioned to receive stick confections from the bed of rollers 41, to a bar inverting position shown in phantom in FIG. 6, in which they discharge the stick confections in an inverted position above the upper run of the conveyor 32.

The conveyors 31 and 32 are advantageously driven in continuous fashion and provision is made for timing the deposit of stick confections on the conveyors with the advance of the conveyors. For this purpose, a first group of spaced stick confections support plates 36 are mounted on the stationary support structure 35 at a level above the inlet portion of the conveyor 31, at locations intermediate the inverter trays 47, to receive and support a first group of alternate ones of the wrapped stick confections above the conveyor 31. A first rake mechanism 37 is mounted for reciprocating movement along a path paralleling the inlet portion of the conveyor 31 and includes a plurality of pushers mounted at spaced locations along a rod **37*a* for pushing a stick confection off a respective one of the support plates 36 and onto the conveyor 31. A second group of spaced stick confection support plates 49 are mounted on the stationary support structure 35 at a level above the inlet portion of the conveyor 32, at locations aligned with respective ones of the inverter trays 47 to receive the stick confections that are inverted and discharged from the inverter trays. A second rake mechanism 50 is mounted for movement along a path paralleling the inlet portion of the second conveyor 32 and has a plurality of pushers mounted at spaced locations along an actuator rod 50*a* for pushing stick confections off a respective one of the support plates 49 and onto the conveyor 32. The rod 37*a* of the first rake mechanism is slidably mounted on the stationary support structure 35 and is reciprocated by a double action air cylinder 39. The rod 50*a* of the second rake mechanism is also slidably mounted on the stationary support structure 35 and is reciprocated by a double action fluid cylinder 54. As best shown in FIGS. 6–9, the pushers 37 and 50 are swingably connected as by pivots 37*b* and 50*b* to their respective actuator rods and the support plates 36 and 49 are swingably connected as by pivots 36*a* and 49*a* respectively to the stationary support 35**, to allow the pushers and support plates to swing upwardly or raised in case a bar is caught between support plates and conveyor and for operator safety and to also allow them to be manually raised for clearing the area below.

When a group of wrapped stick confections are discharged from the wrapping machine 21 and advanced by the bed of rollers 41, alternate ones are deposited on the inverter trays 47 and the other alternate ones drop directly onto respective ones of the support plates 36. A stop 40 (FIGS. 6 and 7) is provided at a location to engage the ends of the stick confections that are deposited on the plates 36 to control the position of those stick confections in a direction laterally of the conveyor 31. The inverter trays are thereafter moved to their dotted line position in FIG. 6, to invert and discharge alternate ones of the stick confections onto the support plates 49. The rakes 37 and 50 are moved forwardly in the direction indicated by the arrows in FIGS. 8 and 9, in timed relation with the conveyors to push the groups of stick confections off the respective support plates 36 and 49 and onto the conveyors 31 and 32 in advance of the pushers PP on the conveyors. With this arrangement, the stick confections that were spaced on three inch centers at the outlet of the bed of rollers 41, will now be spaced on six inch centers on the conveyors 31 and 32. The product pushers PP on the conveyors are pitched apart along the conveyors 31 and 32 at six inch centers to engage and push the stick confections on the respective conveyors. In order to inhibit shifting of the stick confections in a direction longitudinally of the conveyors, product locators PL are provided between each of the pushers PP, at a location to engage the lead side of the stick confection in the pocket. The product locators PL preferably have a height substantially shorter than the height of pusher pins PP. As best shown in FIG. 6 the inverter trays 47 are operated by a cylinder 51 that reciprocates a rack 52 meshing with a pinion 53 on the shaft 48.

The conveyors 31 and 32 advance the stick confections with their stick ends in juxtaposition from the loading station L past the weighing station W. In the embodiment shown, the conveyors have curved portions intermediate the loading station and the weighing station, and the lengths of the curved portions of the first and second conveyors 31 and 32 are relatively different due to their different distance from the center of the curve. The lengths of the curved portions 31 and 32 of the conveyors are arranged so that the product pushers PP on the conveyors 31 and 32 are disposed in transverse alignment as they move past the weigh station, to advance wrapped stick confections in opposed pairs to and away from the weigh station. In the embodiment shown, the product pushers PP on the conveyors 31 and 32 are in transverse alignment as they enter the curved portions of the conveyors and the curved portion of the conveyor 31 has a length greater than the length of the curved portions of the conveyor 32 by an amount equal to a multiple of the pitch of the product pushers along the conveyors. The stick confections on the first and second conveyors shift relative to each other in a direction lengthwise of the conveyors as they move around the curved portion, and the curved portions of the conveyor are offset horizontally and vertically relative to each other a distance sufficient to allow the stick end portions of the stick confections on the two conveyors to shift relative to each other as they are advanced around the curved portions on the respective conveyor. Since the stick confections on conveyor 32 travel a shorter distance from the loading station to the weighting station, the rake 50 is operated at a time after operation of the rake 37 and such that the groups of stick confections deposited on the conveyors 31 and 32 at the loading station will be in transverse alignment as they move past the weighing station. Lateral guides **33*a* and 34*a*** are preferably provided along at least the curved portions of the conveyors, to inhibit shifting of the stick confections in a direction laterally of the conveyors.

A weigh scale 61 at the weigh station W is arranged to weigh pairs of bars advanced by the conveyors 31 and 32 to the weigh station. In order to maintain the stick confections in pairs as they are being weighed, the conveyors 31 and 32 have intermediate portions which extend past the weigh scale, to not only convey the stick confections in pairs to the weigh station, but to also convey the stick confections in pairs away from the weigh station and to the stacking station. The weigh scale is of a type which is adapted to weigh articles while they are in motion and is preferably of the type having a scale conveyor on the weigh table such as is presently being marketed by the Icore division of Acurex Corporation, Mountain View, Calif., under the name "Autochecker 2000". In general the weigh scale includes a weigh table 62 connected to a weigh apparatus 63 (FIG. 2) and scale conveyors 65*a* and 65*b* mounted on the weigh table for advancing stick confections from the conveyors 31 and 32 across the weigh table. As best shown in FIGS. 10, 11 and 12 the scale conveyors 65*a* and 65*b* each have four wheels 66*a* and 66*b* respectively arranged in pairs at opposite sides of the respective conveyors 31 and 32, and endless belts 68*a*, 68*b* that extend between the wheels at each side of the respective conveyor. At the weigh station, the conveyor 31 is guided by the conveyor support 33 at a level $L_1$ and the conveyor 32 is guided by the conveyor support 34 at a level $L_2$ sufficiently above the level $L_1$ to maintain the stick ends of the pairs of stick confections vertically separated as they move across the weigh scale. The wheels of the scale conveyors 65*a* and 65*b* are arranged to support at least a portion of the upper runs of the scale conveyor belts at a level above the level of the respective conveyor 31, 32 as it passes the weigh station, to lift the stick confections off the conveyors. As best shown in FIGS. 11 and 12, the wheels at the inlet ends of the scale conveyors 65*a*, 65*b* have a diameter to extend generally tangent to the respective conveyor 31, 32 and the weigh table 62 is inclined upwardly in the direction of advance of the conveyors 31, 32 so that the wheels at the outlet ends of the scale conveyors project above the respective scale conveyor. Thus, the upper runs of the belts 68*a*,68*b* are inclined upwardly relative to the respective conveyor 31, 32 to lift the stick confections off the conveyors. Since the conveyor 32 at the weighing station is at a level above the conveyor 31, the wheels on the scale conveyor 65*b* have a diameter larger than the corresponding wheels on scale conveyor 65*a*. It is desirable to not only lift the stick confections off the conveyors 31 and 32, but to also move the stick end confections out of engagement with the product pushers PP so that the stick confections are substantially free from the conveyors 31 and 32 during the weighing operation. For this purpose, the scale conveyors are driven from a scale conveyor drive motor 64 at a speed only slightly higher than the speed of the conveyors 31 and 32 so as to move the stick confections forwardly relative to the respective conveyor and away from the trailing product pushers PP. As best shown in FIGS. 10–12, the scale conveyor drive motor 64 is conveniently mounted on the weigh table 62 and has drive pulleys 64*a*, 64*b* on its output shaft. An intermediate portion of the lower run of one of the belts 68*a* is passed laterally over idler pulleys 69*a* and around drive pulley 64*a*, and an intermediate portion of one of the belts 68*b* is passed laterally over idler pulleys 69*b* and around drive pulley 64*b*, so that both belts 65*a*, 68*b* are driven by motor 64 at the same speed.

As shown in FIG. 13 the conveyor guide members 33 and 34 support the respective conveyors 31 and 32 at levels that are vertically offset from each other a distance at least equal to one-half the bar thickness, as the conveyors exit from the weigh station and advance to the ejecting station E. Air blast nozzles 75*a* and 75*b* are provided at the ejecting station E and positioned as shown in FIG. 13 to direct two air blasts upwardly and outwardly against stick confections on the conveyors 31 and 32 as they move past the eject station. A hood 77 overlies the ejecting station E and chutes 78 extend outwardly and downwardly from the ends of the hood to direct ejected stick confections to suitable receptacles 79 (FIGS. 1, 10 and 14). For frozen type stick confections the receptacles are preferably refrigerated or at least heavily insulated to preserve the ejected stick confections until they can be manually sorted and packaged.

The weigh scale 61 is arranged to compare a preset weight with the weight of the stick confections advanced by each pair of pushers on the conveyors 31 and 32 to the weigh station and, when the total weight of the stick confections advanced by a transversely aligned pair of product pushers PP on conveyors 31 and 32 is less than the preset weight, the weigh scale is arranged to operate a valve to apply air to the ejector nozzles 75*a* and 75*b*, when that pair of transversely aligned pushers thereafter move past the ejecting station. For example, the ejector station E is herein shown spaced in the direction of advance of the conveyors 31 and 32 from the weigh station a distance two times the pitch of the product pushers PP on the conveyors, and the weigh scale is arranged in a manner described more fully hereinafter to feed a signal to a shift register which will operate the ejector nozzles, after the conveyors have advanced a distance corresponding to twice the pitch distance of the product pushers. As will be readily appreciated, the total weight of the stick confections advanced by a pair of transversely aligned pushers on the conveyors 31 and 32 can be less than the desired weight if either one of the stick confections is underweight or if one of the stick confections is missing. A single valve is provided for controlling flow through the ejector nozzles 75*a* and 75*b* and is arranged to simultaneously apply air to both nozzles to eject the stick confections from both conveyors 31 and 32 at the ejector station, if the combined weight of the pair of stick confections is less than the preselected weight. This not only removes an underweight stick confection, but also removes the other stick confection of that pair, so that only transversely aligned pairs of full weight stick confections continue to be advanced by the conveyors 31 and 32 to the stacking station.

The conveyor guide members 33 and 34 are preferably constructed and arranged to support the conveyors 31 and 32 horizontally spaced apart a distance such that the stick ends of the stick confection are only in partial overlapping relation such as shown in FIG. 3, as they move past the weigh station W and the ejecting station E, and the support members 33 and 34 have relatively converging portions as shown in FIGS. 1, 10 and 14 to bring the outlet ends of the conveyors 31 and 32 into relatively closer parallel relation as they advance to the stacking station S. Provision is made for pressing the stick confections on the conveyors 31 and 32 into full overlapping relation such as shown in FIG. 4, as they advance to the stacking station. For this purpose, endless belts 79*a*, 79*b* are mounted on pulleys 80, 81 for movement in a generally horizontal plane at the level of the stick confections on the associated conveyor, and each belt has one run that converges relative to the associated conveyor in its direction of advance to engage the outer ends of the stick confections and press them toward each other. The pulleys 80 are mounted on upright shafts 82 and are each driven in the directions indicated by arrows in FIG. 14 by a belt drive 85.

A group forming means is provided at the stacking station S for assembling opposed pairs of wrapped stick confections from the first and second conveyors 31 and 32 into groups comprising a plurality of pairs of wrapped stick confections. The group forming means includes first and second pairs of stacking wheels 101*a* and 101*b* mounted on a shaft 102 at the outlet end of the conveyors 31 and 32. The conveyor guide members 33 and 34 are arranged to support the outlet end of the conveyor 32 a at a level offset above the level of the conveyor 31 a distance approximating one-half the thickness of the stick confections and the stacking wheels 101*a* and 101*b* have slightly different diameters to accommodate the different levels of the outlet ends of the conveyors 31 and 32. The stacking wheels each have a plurality of pockets in their outer periphery and each pocket has a radial wall portion 104 and a chordal wall portion 105 extending from the wall 104 in a direction generally perpendicular thereto. The chordal wall portions 105 are disposed at a level adjacent the level of the respective conveyor 31, 32 to receive stick confections therefrom, when the pocket is at the top of the stacking wheel. The pockets are pitched apart around the periphery of the stacking wheels and the stacking wheels are driven in timed relation with the conveyors 31 and 32 so that each pusher PP on the conveyors advance a stick confection into the pockets on the stacking wheels. Resilient hold down fingers 167 are provided above the conveyors 31 and 32 adjacent the stacking wheels to hold down the stick confections as they transfer from the conveyors to the stacking wheels. Advantageously, the stacking wheels are formed with a number of pockets corresponding to one-half the number of stick confections that are discharged in groups from the wrapping machine. As previously mentioned, the machine shown herein is designed for use with a fourteen lane wrapping machine and the stacking wheel will accordingly have seven pockets. With this arrangement, the stacking wheels complete one revolution for each group of stick confections discharged from the wrapping machine.

A stacking ramp 111 is mounted on a support structure to extend upwardly and outwardly from the stacking wheels at a location angularly spaced from the ends of the conveyors 31 and 32. Thus, as the stacking wheels 101*a* and 101*b* are rotated in the direction indicated by by the arrow in FIGS. 15 and 16, the stick confections are moved with the stacking wheels from the conveyors to the ramp. When the ramp engages and stops movement of the stick confections with the stacking wheels, the chordal portions 105 of the stacking wheels cam the pair of stick confections outwardly of the stacking wheel until they ride on the peripheral portion 106 of the stacking wheels to allow stick confections in the next succeeding pocket on the stacking wheels to move in behind the stick confections on the ramp. As best shown in FIGS. 15 and 16, flexible hold-down straps 168 are advantageously mounted on the frame to extend downwardly into engagement with the stick confections as they are stacked on the ramp 111, to hold the stick confections down on the ramp and inhibit the lead stick confections from tipping forwardly during accumulation of a group of stick confections on the ramp.

The conveyors 31 and 32 and stacking wheels 101*a* and 101*b* are driven in timed relation with each other to advance the conveyors a distance equal to the pitch between adjacent product pushers PP, while angularly turning the stacking wheels a distance corresponding to the pitch of the pockets around the stacking wheel. As best shown in FIGS. 14 and 15 a variable speed drive motor 115 is connected through a gear box 116 to a drive sprocket 118, and the drive sprocket is connected through a chain 119 to a sprocket 121 on the shaft 122. The outlet ends of the conveyors 31 and 32 extend downwardly over idler sprockets 123 (FIG. 14) and over idler wheels 124 (FIGS. 15 and 16) and then around drive sprockets 125 on the shaft 122. The stacking wheels 101*a* and 101*b* are driven from a sprocket 126 on the shaft 122 through a chain 127 and a sprocket 128 on the shaft 102. The belts 79*a* and and 79*b* are driven from pulleys 135 on the ends of shaft 122 through belts 136 and the aforementioned belt drives 85. The size of the various sprockets and wheels are selected so as to rotate the stacking wheels 101*a* and 101*b* through an angle corresponding to the angular spacing between adjacent pockets while the conveyors 31, 32 and auxiliary conveyor 86 are advanced a distance equal to the pitch of the product pushers PP therealong, and the belts 79*a* and 79*b* are driven so that their lineal speed is approximately equal to the speed of movement of the stick confections on the conveyors.

As best shown in FIGS. 16 and 17, an endless type group conveyor mechanism 150 is provided for advancing groups of stick confections along the stacking ramp 111. In the embodiment shown the group conveyor mechanism is adapted to convey groups of articles to either a transfer mechanism 151 for transfer to a boxing machine or onto a loading platform 152, for hand loading in boxes. The loading platform 152 extends from the upper end of the stacking ramp 111 and the group conveyor mechanism comprises three parallel plate type conveyors 153 (FIG. 17) entrained around sprockets 154 disposed tangent to the lower end of the stacking ramp 111, and over sprockets 155 tangent to the upper end of the stacking ramp and to inlet end of the loading platform 152, and sprockets 156 tangent to the outlet end of the loading platform. The group conveyors 153 have pushers 157 spaced apart therealong at distances greater than the maximum length of the group to be formed and the drive sprockets 156 have a diameter to advance the group conveyors a distance corresponding to the pitch of the pushers therealong during one revolution of the drive sprockets. As best shown in FIG. 16, the group conveyors are driven from a drive motor 159 through a clutch-brake unit 161 and speed reducer 162. A sprocket 163 on the output shaft of the speed reducer is connected through a chain 164 to a drive sprocket 165 drivingly connected to a shaft 166 that supports the sprockets 156. When a predetermined number of paired stick confections are stacked on the stacking ramp 111, the group conveyor is operated to advance the group of paired stick confections away from the stacking station. In the embodiment illustrated, a retro-reflective photoelectric detector PE1 is provided for sensing when a pair of paired stick confections are present in the pocket on the stacking wheels as the pockets move from the end of the conveyors 31 and 32 to the stacking ramp. The photoelectric detector is arranged to control operation of a counter described more fully hereinafter to count the number of paired stick confections advanced to the stacking ramp and to actuate the group conveyor after a preset number have been advanced to the stacking ramp. Lateral guides 169*a* and 169*b* (FIGS. 16 and 17) are provided along opposite sides of the stacking ramp 111 to laterally confine the groups of stick confections as they are advanced up the ramp.

If stick confections are absent from a pocket on the stacking wheels as they are rotated to the stacking ramp, the stick confections previously stacked on the ramp could then move back into the empty pocket. A bar holding apparatus 175 is provided to prevent such retrograde movement of the stacked stick confections. As best shown in FIGS. 15 and 16, the bar holder 175 comprises two generally L-shaped levers attached to a shaft 176 for vertical swinging movement and each having a head 175*a* at its outer end movable between a retracted position spaced inwardly of the pockets on the respective stacking wheel to an extended position spaced outwardly of pockets to engage the end pair of stacked stick confections on the stacking ramp and prevent retrograde movement. The bar holder is normally retracted inwardly of the pockets on the stacking wheel and is moved to its extended position by an air cylinder 178 (FIG. 15) connected to an arm 179 on the shaft 176. As described more fully hereinafter, the photoelectric detector PE1 is also arranged to control operation on the bar holder to extend the bar holder in the absence of a pair of stick confections in the pockets on the stacking wheels as they are moved to the stacking ramp.

The transfer mechanism 151 is arranged to transfer groups of stick confections off the stacking ramp 111 to the infeed conveyor mechanism 180 of an automatic cartoning or boxing machine designated generally by the numeral 181. The automatic cartoning machine may be of any suitable construction capable of erecting a carton, loading the groups of stick confections fed thereto into cartons, and thereafter closing the cartons. The cartoning machine may, for example, be of the type presently manufactured by Hayes Machine Co. of Marshall, Mich., and designated Model 515B30LH. Details of the construction of the cartoning machine form no part of the present invention and further detailed description of the cartoning machine is deemed unnecessary.

A stop 185 is provided above the stacking ramp 111 at a location to extend crosswise of the ramp for engaging the lead pair of stick confections in a group advanced by the group conveyor 153. The stop 185 is supported on a head 186 that is mounted on guide rods 187 slidable in a guide block 184 for movement toward and away from the stacking ramp. A fluid actuator 188 has its actuator rod 188*a* connected to the head 186, to move the stop member 185 between a lower or stop position as shown in FIGS. 16 and 17, to a raised position out of the path of movement of the stick confections by the group conveyor 153. The stop 185 is also supported for swinging movement relative to the head about a pivot 189 and is yieldably biased by a spring 190 to the position shown in FIG. 16. In the event of a jam up in the transfer mechanism 151, such that the group of stick confections is not removed from the group conveyor, then the stop 185 is adapted to yield and pivot to the position shown in dash lines in FIG. 16, to allow the group of stick confections to be advanced onto the loading platform 152.

The transfer mechanism 151 includes a transfer carriage 191 supported on guide rods 192 for movement in a direction crosswise of the group conveyor 153. A fluid actuator 194 has its operator 194*a* connected to the carriage 191 to extend and retract the carriage. A pusher 196 is pivotally mounted on the carriage for movement about an axis 197 between a lower position as shown in FIG. 17 and a raised position, and a fluid actuator 198 is connected to the carriage and has its actuator rod 198*a* connected to the pusher 196, to raise and lower the latter. Controls, described more fully hereinafter, are provided for moving the pusher to its lower position when the carriage is fully retracted and for holding it in its lower position as the carriage is extended and for thereafter raising the pusher during retraction of the carriage so as to clear a succeeding group of stick confections as they are advanced to the transfer mechanism.

An improved timing control is provided for timing various functions of the packaging apparatus in timed relation with the operation of the conveyors and stacking wheels. As best shown in FIGS. 19–25, the timing control is mounted in a control box 200 and includes a star wheel 201 mounted on the stacking wheel shaft 102 for rotation therewith in the direction indicated by the arrow in FIG. 19, and having a number of lobes 202 corresponding to the number of pockets in the stacking wheels. The lobes are preferably of triangular shape with a lead edge 202*a* and a trail edge 202*b*. The timing control advantageously uses retro-reflective photoelectric sensors and provision is made for adjustably mounting the sensors to enable adjustment of the timing and duration on the actuation of the photoelectric sensors. For this purpose, a fixed mounting plate 204 is mounted as by a support 205 on a stationary structure and a plurality of brackets 208, one for each photoelectric sensor, are mounted on the plate 204 for angular adjustment about an axis concentric with the shaft 102. In FIGS. 19 and 24, four photoelectric sensors are shown, it being understood that additional photoelectric sensors up to the number of lobes on the star wheel can be provided in a similar manner. The mounting plate has a plurality of arcuate slots 206 disposed concentric with the axis of rotation of the star wheel 201 and the brackets 208 are each adjustably secured to the plate 204 by a clamp plate 209 and fasteners 210 that extend through a respective one of the slots 206. A pinion 203 is rotatably mounted on each bracket 208 and meshes with a stationary gear 207 concentric with the axis of shaft 102. The pinion 203 is fixed to a shaft 203*a* that extends through the slot and through the clamp plate, so that angular adjustment of the brackets can be effected by turning the shafts 203*a*. The brackets 208 have a slot 212 therein disposed in a line that parallels a tangent through the roots of the lobes 202 on the star wheel, and a head 211 is mounted as by a clamp plate 214 and fasteners 215 that extend through the slot 212 for adjustment in a direction lengthwise of the slot. A pinion 216 is rotatably mounted in the head 211 and clamp plate 214 meshes with a rack 217 on the bracket 208 to adjust the head along the slot in response to rotation of the pinion. Each pinion 216 is fixed to a shaft 216*a* that extends through the slot 212 and through the clamp plate 214 so that the position of the head can be adjusted along the slot 212 in response to turning of the shaft 216*a*. A photoelectric sensor PE is mounted on each of the heads 211 for movement therewith.

The photoelectric sensors PE are preferably of the retro-reflective type in which the light transmitter and light receiver are both mounted on the same body, and the star wheel has at least its lobe portions formed of a reflective material to reflect light from the transmitter back to the light receiver, when the lobes of the star wheel move past the photoelectric sensor. The edges 202*a* and 202*b* of each of the lobes on the star wheel extend tangent to a circle through the roots of the lobes and the heads 211 are adjustably mounted on the respective bracket to support the photoelectric sensor PE for adjustment along a path tangent to the aforementioned circle. In the embodiments shown, the sensor is adjustable along a line tangent to the leading edge 202*a* of the lobes. Thus, adjustment of the head 211 along the slot 212, adjusts the radial position of the photoelectric sensor relative to the star wheel and, in view of progressively changing radial width of lobes it adjusts the duration of actuation of the photoelectric sensor by the lobes on the star wheel. Adjustment of the bracket 208 on plate 204 angularly about the axis of the star wheel, adjusts the time when the photoelectric sensor is actuated. Thus, the position of the photoelectric sensors can be adjusted angularly about the axis of rotation of the star wheel to control the angular position at which the photoelectirc sensors are actuated and the photoelectric sensors can also be adjustable along the slots 212 to increase or decrease the duration of actuation, without changing the angular position at which the sensors are actuated.

Reference is now made to the electrical and pneumatic circuit diagram in FIGS. 18*a* and 18*b*. Power is applied through a main switch 221 to power conductors 222, 223 and 224. Conductors 222–224 are connected through motor start relay contacts MS1*a* to the infeed conveyor motor 44 and through motor start contacts MS2*a* to the group feed conveyor 159 and through motor start contacts MS3*a* to the vacuum motor 58. Power is also supplied from conductors 222 and 224 through a transformer 225 having a center tap secondary 225*a* that applies low voltage power to conductors 226 and 227. Conductors 226 and 227 are connected through motor contactors C1*a* and C1*b* to the main drive speed control MDSC which controls the main drive motor 115. The main drive motor 115 is of the variable speed type which is controlled by a speed control 228, and the main drive motor is selectively started and stopped under the control of relay contacts CR10*a*. The scale apparatus 63 is of the electronic type and is connected through normally open relay contacts CR1*a* to conductor 227 to be energized when control relay CR1 is energized. Control relay CR1 is connected through normally open start switch contacts PB4*a* and normally closed stop switch contacts PB4*b* of push button switch PB4 to conductor 226 to be energized when the start switch contacts are closed. When relay CR1 is energized, it closes contacts CR1*a* to apply power to the scale apparatus 63 and also closes normally open contacts CR1*b* in parallel with switch PB4*a* to establish a holding circuit for relay CR1, and to apply power from conductor 226 to a control circuit conductor 231. Motor start relay MS1 (FIG. 18*b*) for starting the infeed conveyor motor 44 is energized under the control of normally open relay contacts CR6*a*. Motor start relay MS2 for starting the group conveyor motor 159 is energized under the control of a normally open manually operable switch 232 and normally open relay contacts CR6*a*. Motor start relay MS3 for controlling energization of the vacuum motor 58 is energized under the control of normally open manually operable switch 234 and normally open relay contacts CR6*a*. Main drive contactor C1 is energized under the control of a normally opened manually operable switch 235 and normally open relay contacts CR6*a*. Relay CR6 is a position stop relay and is connected through normally open contacts CR5*b* to control circuit conductor 231. Relay CR5 is connected through normally closed stop switch PB6 and normally open start switch PB5 to conductor 231 so that relay CR5 is energized when the start switch is closed. When relay CR5 is energized, it closes normally open relay contacts CR5*a* to establish a holding circuit and also closes normally open relay contact CR5*b* to energize relay CR6. When relay CR6 is energized, it closes contacts CR6*a* previously described and also closes contacts CR6*b* to establish holding circuit through any one of normally open, parallel-connected contacts CR11*b*, CR9*a*, and CR17*a*. Thus, if relay CR5 is de-energized by operation of stop switch PB6, relay CR6 will remain energized until all of the relay contacts CR11*b*. CR9*a* and CR17*a* are opened. These relay contacts are operated in a manner described hereinafter to assure that the packaging machine will stop in a predetermined position. Energization of relay CR6 also closes relay contacts CR6*c*.

A mode control switch 239 is provided with contacts 239*a*–239*f*. Contacts 239*a*, 239*b*, 239*d* and 239*e* are closed in the automatic mode position of the switch and contacts 239*c* and 239*f* are closed in the manual mode position of the switch. When the manually operable switch 235 is closed to energize the main drive contactor C1, power is also applied to a terminal designated X in FIG. 16*b*. Main cycle relays CR9 and CR10 are connected through normally open relay contacts CR5*c*, and contacts 239*a* of mode switch 239 to the terminal X. Contacts CR5*c* are closed by relay CR5 when the packaging machine is started and, if switch 239 is in its automatic mode position, relays CR9 and CR10 will be energized and remain energized until stop switch PB6 is operated. Energization of relay CR10 closes contacts CR10*a* in the main drive speed control MDSC to start the cycle drive motor 115 and the main drive motor will remain energized until relay CR5 is de-energized by operating the stop switch PB6. Provision is made for controlling the position of the conveyors 31 and 32 at which the machine will stop when stop switch PB6 is operated. Energization of relay CR9 closes normally open relay contacts CR9*a* in the holding circuit for relay CR6 and also closes normally open contacts CR9*b* that are connected through normally open relay contacts CR16*b* and contacts 239*b* of mode switch 239 to terminal X. Cycle timer contacts CS*a* are connected in parallel with relay contacts CR16*b* so that a holding circuit is provided for relays CR9 and CR10 when either relay contacts CR16*b* or cycle timer contacts CS*a* are closed. Relay contacts CR16*b* are closed when cycle timer relay CR16 is energized in a manner described hereinafter, to prevent stopping of the main drive motor until the loading cycle has been completed. Cycle timer contacts CSa are opened and closed each time the conveyors 31 and 32 are advanced one pitch distance by a cycle timer CS having its photoelectric sensor PE3 operated from the star wheel 201. The photoelectric sensor PE3 is adjusted so that relay contacts CSa open to stop the conveyors 31 and 32 at a position such that any stick confections on the stacking wheels will be just short of a position to be detected by photoelectric sensor PE1. This assures that any stick confections on the stacking wheel at the time the machine is stopped, will be counted when the machine is restarted. Relays CR9 and CR10 are also connected through a normally open manually operable jog switch 242 and the contacts 239*c* of the manual-auto switch 239 to the terminal X, to enable momentary energization of the relays CR9 and CR10 under control of jog switch 242, when the mode switch 239 is in its manual position.

Air pressure to the cylinder 51 for operating the tray inverter is reversibly supplied through a valve 251 controlled by an electroresponsive actuator or solenoid S6. The tray inverter is operated each time a group of stick confections are discharged from the wrapping machine. As shown in FIG. 18*b*, when relay CR5 is energized and closes relay contacts CR5*a*, power is also applied to terminal W and the solenoid S6 for operating the tray inverter valve 251 is connected through normally closed relay contacts CR15*a* and normally open cycle switch 238 to the terminal W. Solenoid S6 will be energized each time switch 238 is closed to invert and discharge alternate bars of the group onto support plates 49. A manually operable switch 237 is provided in parallel with cycle switch 238 to enable manual initiation of a loading cycle. Switch 238 is arranged to be closed a preselected time after the wrapping machine discharges a group of stick confections, which time is made sufficient to allow the group of confections to be advanced by the infeed rollers 41 to the invertor trays 47 and stick confection support plates 36. The switch 238 may, for example, be operated from a cam that is cycled each time the wrapping machine cycles. Relay CR16 is also connected to switch 238 to be energized when it is closed and, when relay CR16 is energized, it closes relay contacts CR16*a* to establish a holding circuit through normally closed contacts TD4*a* of time delay relay TD4. Relay CR15 and time delay relay TD4 and a time delay relay TD6 are connected in parallel with each other and in in series with normally open relay contacts BXa and normally open switch 253 to the normally closed relay contacts TD4*a*. Switch 253 is mounted to be closed when the rack 52 is fully raised to invert the trays. Relay contacts BXa are operated by a photoelectric relay BX having its photoelectric sensor PE6 positioned to be operated by star wheel 201 to open and close contacts BXa each time the conveyors 31 and 32 are advanced one pitch distance, to control energization relay CR15 and time delay relays TD4 and TD6 after switch 253 is closed, in timed relation with the conveyor movement. When relay CR15 is energized, it closes relay contacts CR15*b* to establish a holding circuit and opens contacts CR15*a* to de-energize solenoid S6 and allow the tray inverter cylinder 251 to return the trays to a position for receiving alternate ones of a succeeding group of stick confections.

Air is reversibly supplied to the air cylinder 39 for the rake mechanism 37 by a four-way flow reversing valve 254 having an electroresponsive actuator or solenoid S7. Solenoid S7 is connected through time delay relay contacts TD6*a* and TD6*b* to normally closed relay contacts TD4*a*. When relay TD6 is energized, it immediately closes normally open contacts TD6*a* to energize solenoid S7 and actuate the rake mechanism 37 to discharge stick confections from the supports 36 onto the conveyor 31. After a short time delay, of the order of four to six tenths of a second and sufficient to allow the rake mechanism 37 to reach its full forward position, relay TD6 opens normally closed contacts TD6*b* to de-energize solenoid S7 and allow the rake mechanism to be retracted.

As previously described, the conveyors 31 and 32 travel through a curve between the loading station and the weighing station, and conveyor 32 between the loading station and weighing station is shorter than conveyor 31. The air cylinder 54 for actuating the rake 50 to discharge confections from support plates 49, is operated under the control of a four-way valve 256 having an electroresponsive actuator or solenoid S8. Solenoid S8 is energized under the control of normally open relay contacts TD5*a* and TD5*b* of time delay relay TD5, and time delay relay TD5 is controlled by normally open relay contacts TD4*b* of time delay relay TD4.

Time delay relay TD4 is set in accordance with the conveyor speed and is adjusted to delay opening of contacts TD4*a* and closing of contacts TD4*b* for a time interval sufficient to allow the conveyor 32 to travel a predetermined distance such that the group of stick confections deposited on conveyor 32 will be in transverse alignment with the group of stick confections deposited on conveyor 31 when both groups move past the weigh station. In the embodiment illustrated, the delay in relay TD4 is set to allow the conveyor to travel a distance of about three and one-half times the pitch distance of the pushers PP. When energized, time delay relay TD4 momemtarily closes contacts TD4*b* to energize time delay relay TD5 and relay TD5 immediately closes normally open contacts TD5*a* to energize the solenoid S8 for operating the rake mechanism 50. A short time delay after it is energized, sufficient to allow the rake 50 to move to its full forward position, time delay relay TD5 opens contacts TD5*b* to de-energize solenoid S8 and allow the rake to return. Energization of relay TD4 also momentarily opens contacts TD4*a* to de-energize relays CR16 and CR15.

As the conveyors 31 and 32 move past the weigh station, the pushers on the conveyor are in transverse alignment and are adapted to advance stick confections in pairs to the scale 61. A photoelectric sensor 64′ is positioned at a preselected location along the scale as shown in FIGS. 10–12 to detect the arrival of stick confections on either of the conveyors 31 and 32. When the photoelectric sensor 64′ detects arrival of a stick confection on either conveyor, the scale apparatus 63 is operated to compare the combined weight of the stick confections at that location to a preselected minimum weight and to produce a weight data signal when the combined weight is below a preselected minimum. As schemmatically shown in FIG. 18*a*, the scale apparatus 63 is arranged to momentarily actuate relay CR19 to close relay contacts CR19*a*, when the weight is below the preselected minimum.

The ejector station is spaced along the path of the conveyors from the weighing station a distance corresponding to several pitches of the product pushers PP along the conveyors, and the weight data signal from the scale is fed to a shift register 254 that is clocked or shifted in timed relation with the conveyors to cause the weight data information to move electrically through the register as the stick confections are advanced by the conveyors. Clock or shift pulses, one of each pitch length of travel of the conveyors 31 and 32, are entered into the shift register by closing relay contacts BRTa operated in timed relation with the conveyor. Relay contacts BRTa are controlled by a photoelectric bar reject timer BRT having a photoelectric sensor PE5 operated from the star wheel on shaft 102.

The shift length of the register is programmed to correspond with the distance between the weigh station and the ejector station (measured in pitches of the product pushers PP along the conveyors) and, when a below weight data signal is fed into the input of the shift register by closing of relay contacts CR19*a*, the shift register actuates an output relay CR20 after the programmed shift length, to close relay contacts CR20*a* and energize solenoid S5. Air is supplied to the ejector nozzles 75*a* and 75*b* under the control of an on-off valve 255, and solenoid S5 is operative, when energized, to move the valve to a position to supply air from an air supply line AIR to the ejector nozzles to discharge stick confections from both conveyors at the ejector station. Thus, only pairs of stick confections of the proper total weight are advanced from the ejector station to the stacking station.

The pushers on the conveyors 31 and 32 advance pairs of stick confections to the pockets on the stacking wheels 101*a* and 101*b* and the stacking wheels rotate to transfer the stick confections to the stacking ramp 111 and to advance previously stacked confections on the stacking ramp upwardly along the stacking ramp to receive the next pair of stick confections. When a pair of stick confections are absent from a pocket on the stacking wheel as it moves through the stacking station, the previously stacked confections could move downwardly into the empty pocket and might tilt or tip over. Air pressure is reversibly supplied to the cylinder 178 for operating the bar holder 175 under the control of a flow reversing valve 257 operated by an electroresponsive actuator or solenoid S4. A photoelectric bar detector BD is connected to the previously described photoelectric sensor PE1 that is mounted to sense the presence or absence of a pair of stick confections on the stacking wheels as they are advanced to the accumulator station. Photoelectric bar detector BD is arranged to close contacts BDa when it senses the presence of a pair of bars in a pocket on the stacking wheels as they are advanced to the accumulator table, and relay contacts BDa are connected to a control relay CR13 to energize the same. When relay CR13 is energized, it closes relay contacts CR13*a* connected to the counter CTR having a manual reset switch RS. Control relay CR7 and solenoid S4 are connected through normally closed relay contacts CR13*b* and normally open relay contacts BIa to the control circuit conductor 231. Relay contacts BIa are operated from a photoelectric bar interrogator BI having photoelectric detector PE2 operated in timed relation with the rotation of the stacking wheels by the star wheel 201. Photoelectric detector PE2 is angularly positioned so as to actuate the photoelectric bar interrogator BI and close contacts BIa when a pocket in the star wheel moves past the photoelectric sensor PE1. If a pair of bars are sensed by photoelectric sensor PE1 of bar detector BD at this time, the control relay CR13 will be energized to open contacts CR13*b* and prevent energization of control relay CR7 and solenoid S4. However, if a pair of stick confections are absent from the pocket at this time, control relay CR7 and solenoid S4 are energized and relay CR7 closes relay contact CR7*a* to establish a holding circuit to maintain relay CR7 and solenoid S4 energized until relay CR13 is again energized. When solenoid S4 is energized, it operates valve 257 to apply fluid pressure to cylinder 178 in a direction to move the bar holder 175*a* into its bar holding position, to prevent retrograde movement of the stick confections on the accumulating ramp.

When the switch 233 is closed, it also applies power to a terminal designated Y in FIG. 18*b*. Control relays CR17 and CR18 are connected through normally open counter contacts CTRa and normally open contacts BSa, and contacts 239*e* of mode switch 239 to the terminal Y. Photoelectric timer BS for the bar stripper has a photoelectric detector PE4 operated from the star wheel in timed relation with the rotation of the stacking wheel and closes contacts BSa as the stacking wheel is turned through an angle corresponding to the angular pitch of the pockets. When the counter CTR counts a preselected number of pairs of bars, for example eight, it closes contacts CTRa and energizes relays CR17 and CR18. A clutch-brake control CBC for the group conveyor clutch brake 161*c*, 161*b*, is also operated when the counter contacts CTRa are closed, to energize the clutch and de-energize the brake. A cam operated switch 261 is connected in parallel with relay contacts BSA and counter contacts CTRa to establish a holding circuit for relays CR17, CR18 and the clutch brake control. Switch 261 is operated from a cam 260 on the group conveyor drive shaft, and the cam is arranged to maintain the switch 261 closed until the group conveyor is advanced a distance corresponding to the spacing between the pushers 157 on the group conveyor. Contacts 239*f* of the machine cycle control switch 239 are connected in series with a normally open push-button switch PB7 to the clutch brake-control, to enable selective operation of the clutch-brake control in the manual position of the switch 239.

When the group conveyor 150 is operated, it advances the preceding group of stick confections to the transfer station against the stop 185. Fluid is reversibly supplied to the transfer cylinder 194 under the control of a valve 266 operated by an electroresponsive solenoid S3. Fluid is reversibly supplied to the pusher cylinder 198 through a valve 267 controlled by a solenoid S2. A control relay CR11 is connected through normally open relay contacts CR18*a* and normally closed relay contacts CR4*a* of cross-feed jam relay CR4 to the control conductor 231. It is also connected through normally open relay contacts CR11*a* and transfer position switch 271*a* and normally closed relay contacts CR4*a* to the conductor 231. Switch 271*a* is closed when the transfer mechanism is not in its full forward position. When the control relay CR18 is energized, it opens contacts CR18*b* and closes contact CR18*a* to energize control relay CR11. Relay CR11 when energized, closes normally open relay contacts CR11*a* connected in series with transfer position switch 271*b* to establish a holding circuit for relay CR11. Solenoid S3 and time delay relay TD1 are connected in parallel with each other and in series with normally closed relay contacts CR18*b*, across the relay CR11. When relay CR18 is de-energized at the end of the group feed cycle, relay contacts CR18*b* close and energize solenoid S3 to cause valve 266 to apply pressure to transfer cylinder 194 and extend the transfer mechanism across the accumulator ramp. When the transfer mechanism reaches its full forward position, it opens switch 271*a* and closes a switch 271*b* connected to a relay CR12 and through normally closed contacts CR4*b* of cross-feed jam relay CR4 to the solenoid S2 to energize relay CR12 and solenoid S2. Energization of solenoid S2 operates valve 267 to apply air pressure to the pusher cylinder 198 to raise the pusher. Opening of switch 271*a* interrupts the holding circuit through relay contacts CR11*a* and de-energizes relay CR11 and timer TD1 and solenoid S3. De-energization of solenoid S3 allows valve 266 to return to its normal position and cause the transfer mechanism to retract. Control relay CR12 is operative when energized to close normally open relay contacts CR12*a* connected in series with normally closed switch 272, to establish a holding circuit for relay CR12 and maintain the solenoid S2 energized. Switch 272 is operated by the transfer mechanism and is opened when the transfer mechanism reaches its fully retracted position to de-energize relay CR12 and solenoid S2.

The cross-feed jam relay CR4 is connected through normally closed manually operable reset switch 275 and normally open contacts CR4*c* of relay CR4 to the conductor 231. Relay CR4 is also connected through normally open relay contact TD1*a* of time delay relay TD1 to the conductor 231. In addition, relay CR4 is connected through normally open relay contacts 276 to the conductor 231. The relay contacts 276 are provided in the cartoning machine and are arranged to be closed in the event of a jam in the cartoning machine. Time delay relay TD1 is arranged to close the normally open contacts TD1*a* a time delay after energization, which time delay is selected to provide sufficient time to allow the transfer mechanism to move to its full forward position. If the transfer mechanism reaches its full forward position in the preset time, TD1*a* is not closed and CR4 will not be operated. When the cross-feed jam relay CR4 is energized, it closes contacts CR4*c* to establish a holding circuit through reset switch 275 and opens contacts CR4*a* to deenergize the transfer mechanism solenoid S3. Energizing relay CR4 also opens contacts CR4*b* and closes normally open contacts CR4*d* to establish a circuit to solenoid S2, to maintain the pusher in its raised position. Provision is also made for disabling the transfer mechanism and raising the product stop, when it is desired to advance the groups of stick confections onto the loading platform 152 for manual packaging. For this purpose, a manually operable two-position switch 270 is provided. Contacts 270*a* are connected to relay CR4 to enable selective control of that relay, and contacts 270*b* are connected in series with contacts CR4*c* to disable the holding circuit for relay CR4.

Air under pressure is reversibly supplied to the product stop cylinder 188 through a control valve 281 operated by a solenoid S1. Time delay relay TD3 is connected in parallel with relays CR17 and CR18 and is energized whenever these relays are energized. When time delay relay TD3 is energized, it closes time delay relay contacts TD3*a* for a short time interval sufficient to allow the pushers on the group conveyor to pass below the product stop 185. The solenoid S1 is connected through a circuit including normally closed relay contacts CR4*f* and normally open relay contacts TD3*a* in parallel with relays CR17 and CR18, so that, in the absence of a product jam, the product stop is raised for a time during advance of the group conveyor sufficient to allow the group conveyor pushers to move past the product stop. Solenoid S1 is also connected through normally open relay contacts CR4*c* so that the product stop is operated to its raised position in the event the cross-feed jam relay is energized.

The cartoning machine is operated in timed relation with the transfer of groups of articles off the accumulator ramp. For this purpose, normally open control relay contacts CR17*b* and normally closed relay contacts CR4*g* are connected in series with contacts 239*d* of the mode switch 239, to the cartoning machine, to cycle the cartoning machine in timed relation with the transfer groups of articles. Normally open relay contacts CR17*b* are closed each time the relay CR17 is energized, to cycle the cartoning machine in timed relation with the transfer mechanism. Normally closed relay contacts CR4*f* are opened when the jam relay CR4 is energized, to prevent cycling of the cartoning machine under these condictions.

From the foregoing it is thought that the construction and operation of the packaging apparatus will be readily understood. As the wrapped stick confections are discharged in groups from the wrapping machine, they are advanced by the infeed rollers 41 and alternate ones are deposited stick end first on the support plates 36 while the other alternate ones are deposited on the inverter trays 47. Switch 238 is closed after the wrapping machine 27 discharges a group of wrapped stick confections and this starts a loading cycle in which the inverter trays 47 are oparated to invert and deposit alternate ones of the group of stick confections on the support plates 49 and the rakes are thereafter operated in timed relation with the conveyors to discharge the stick confections from the support plates 36 and 49 onto the conveyors 31 and 32. The conveyors 31 and 32 are operated in continuous motion and advance the stick confections to the weigh station W and are arranged so that the product pushers on the conveyors 31 and 32 are transversely aligned to advance the stick confections in pairs to and from the weigh station. The weigh station compares the weight of the stick confections on the first and second conveyors with a preset weight. When the total weight of the stick confections advanced by a pair of pushers on the conveyors 31 and 32 to the weigh station is less than the preset weight, a signal is fed to the shift register and, after a predetermined shift length, the shift register operates the solenoid for the ejector valve 255 to supply air to the ejector nozzles 75*a* and 75*b* which direct air blasts at the stick confections when that pair of pushers moves past the ejector station.

Pairs of bars advanced by the conveyors to the stacking station are stacked by the stacking wheel onto the accumulator ramp and the number of pairs of bars are counted. The bar stop is operated in the absence of a pair of stick confections in the pocket on the star wheel to prevent retrograde movement of the stack of confections on the accumulator table. When the counter has counted a predetermined number of bars, it operates the group conveyor to advance a group of stacked stick confections along the stacking ramp. Automatic cartoning of the groups of stick confections is effected by the transfer mechanism which is operated in timed relation with the group conveyor to transfer groups of stick confections off the accumulator ramp and into the infeed conveyor of the cartoning machine. The cartoning machine is, in turn, cycled in timed relation with the operation of the transfer mechanism. However, if there is a jam in the transfer mechanism or cartoning machine, the stop 185 is automatically raised to allow the group of stick confections to be advanced onto the loading platform 152 for manual loading.

The embodiments of the invention in which an exclusive property or privilege is claimed are defined as follows:

1. A packaging apparatus for assembling wrapped stick confections from a multi-lane packaging machine into groups with the stick ends of the wrapped stick confections overlapping, comprising, endless type first and second conveyor means each having product pusher means at uniformly spaced locations therealong defining pockets between adjacent pushers for advancing stick confections crosswise of their length from a loading station sequentially past a weighing station and an ejecting station to a stacking station, the first and second conveyor means having relatively parallel inlet portions, means for feeding wrapped stick confections from the multi-lane wrapping machine into the pockets on the first and second endless conveyor means with the stick ends in juxtaposition, weigh scale means at the weighing station, the first and second conveyor means having relatively parallel intermediate portions extending past the weigh scale means with the product pushers on the intermediate portions of the first and second conveyor means arranged in transverse alignment to advance wrapped stick confections in opposed pairs to and away from the weigh scale means, ejector means at the ejecting station adapted when operated to eject wrapped stick confections from both the first and second conveyor means, means responsive to the weigh scale means and operative when the total weight of the wrapped stick confections advanced by a transversely aligned pair of product pushers to the weigh scale means is less than a predetermined value for operating ejector means to eject the stick confections advanced by that pair of transversely aligned pair of product pushers when they advance past the ejecting station, the first and second conveyor means having outlet end portions extending from the ejecting station to the stacking station with the product pushers arranged in transverse alignment to advance wrapped stick confections in opposed pairs and with their stick ends overlapping to the stacking station and group forming means at the stacking station for assembling opposed pairs of wrapped stick confections from the first and second conveyor means into groups comprising a plurality of pairs of wrapped stick confections.

2. A packaging apparatus according to claim 1 wherein said product pushers are spaced apart along said first and second conveyor means a distance substantially greater than the transverse width of the wrapped stick confections, said weigh scale means including endless type first and second scale conveyors having at least a portion of their upper runs disposed at a level above the intermediate portions of the respective first and second conveyor means and below the tops of the product pushers on the respective first and second conveyor means as they move past the weigh scale means.

3. A packaging apparatus according to claim 2 wherein said first and second scale conveyors are mounted on a common weigh scale platform of a single weigh scale.

4. A packaging apparatus according to claim 1 wherein said product pushers are spaced apart along said first and second conveyor means a distance greater than twice the transverse width of the wrapped stick confections, stick confection locator means associated with each product pusher on the first and second conveyor means spaced in advance of the associated product pusher a distance sufficiently greater than the transverse width of a wrapped stick confection to extend adjacent the lead side of a wrapped stick confection engaged by the associated product pusher means, the locator means extending above the respective conveyor means a distance substantially less than the product pushers, said weigh scale means including endless type first and second scale conveyors having at least a portion of their upper runs disposed at a level above the locator means on the respective first and second conveyor means and below the tops of the pusher means on the respective first and second conveyor means as they move past the weigh scale means, and means for driving the first and second scale conveyors at a speed slightly faster than the speed of the first and second conveyor means.

5. A packaging apparatus according to claim 1 wherein said ejector means includes air blast nozzles at the ejecting station operable to direct a stream of air at the underside of the wrapped stick confections at the ejector station.

6. A packaging apparatus according to claim 1 wherein said product pushers are spaced apart on the first and second conveyor means a distance greater than twice the transverse width of the wrapped stick confections, said means for feeding wrapped stick confections from the multi-lane wrapping machine including a first feed means for feeding a first group of alternate ones of the wrapped stick confections from the wrapping machine onto the first conveyor means at the loading station and a second feed means for endwise inverting and feeding a second group of alternate ones of the wrapped stick confections onto the second conveyor means at the loading station.

7. A packaging apparatus according to claim 6 including means for operating said first and second feed means in timed relation with said first and second conveyor means and such that the first and second groups of stick confections that are deposited on the respective first and second conveyor means at the loading station are in transverse alignment as they are advanced past the weighing station.

8. A packaging apparatus according to claim 6 wherein said first and second conveyor portions have curved portions intermediate said inlet portions and said intermediate portions, means for operating said first and second feed means in timed relation with said first and second conveyor means and such that the first and second groups of stick confections that are deposited on the respective first and second conveyor means at the loading station are in transverse alignment as they are advanced past the weighing station.

9. A packaging apparatus according to claim 6 wherein said second feed means includes a plurality of inverter trays spaced apart in a direction paralleling the inlet portion of the second conveyor means and mounted for swinging movement between a receiving position above the inlet portion of the first conveyor means for receiving said second group of alternate ones of the stick confections and a discharge position above the inlet portion of the second conveyor means.

10. A packaging apparatus according to claim 9 wherein said first feed means includes a group of first confection supports overlying and spaced apart lengthwise of the inlet portion of the first conveyor means at locations intermediate the inverter trays for receiving said first group of alternate ones of the wrapped stick confections, a first rake means movable in a direction paralleling the inlet portion of the first conveyor means for moving the stick confections of the first confection supports for deposit on the first conveyor means, said second feed means including a group of second confection supports overlying and spaced apart lengthwise of the inlet portion of the second conveyor means at locations to receive the stick confections discharged by the inverter trays, and a second rake means movable in a direction paralleling the inlet portion of the second conveyor means for moving the second group of stick confections off the second confection supports for deposit on the second conveyor means.

11. A packaging machine according to claim 10 including means for operating said first and second rake means in timed relation with the first and second conveyor means and such that the first and second groups of stick confections that are deposited on the respective first and second conveyor means at the loading station are in transverse alignment as they are advanced by the respective first and second conveyors past the weighing station.

12. A packaging machine according to claim 1 wherein said outlet end portion of the first conveyor means is vertically offset from the outlet end portion of the second conveyor means, and positioning means adjacent said outlet end portions of the first and second conveyor means engageable with the outer ends of the wrapped stick confections on the first and second conveyor means for relatively moving the same toward each other to cause the stick end portions to overlap.

13. A packaging machine according to claim 12 wherein said positioning means includes first and second endless belts each mounted for movement in a generally horizontal plane alongside the respective first and second conveyor means, the first and second belts each having one run that converges relative to the respective first and second conveyor means in their direction of advance.

14. A packaging apparatus according to claim 1 wherein said group forming means includes first and second stacking wheels mounted for rotation about a horizontal axis crosswise of the outlet ends of the respective first and second conveyor means, a stacking ramp extending outwardly from the first and second stacking wheels at a location angularly spaced from the ends of the respective first and second conveyor means, the stacking wheels having notches in their peripheries for receiving a wrapped stick confection from the first and second conveyor means and operative when the stacking wheels are turned to move the wrapped stick confection therewith from the first and second conveyor means to the stacking ramp, the first and second stacking wheels having cam portions on their peripheries intermediate adjacent notches constructed and arranged to move a wrapped stick confection in a direction outwardly from the stacking wheel and along the stacking ramp when the stick confections engage the stacking ramp.

15. A packaging apparatus according to claim 14 wherein the number of pockets in the stacking wheels is one-half the number of stick confections discharged during each cycle of the wrapping machine, and means for driving said first and second stacking wheels in timed relation with said first and second conveyor means.

16. A packaging apparatus according to claim 14 including means for sensing when a stick confection is deposited in the pocket on one of the stacking wheels, counter means operated by said sensing means, and group conveyor means for moving a group of articles along the stacking ramp and away from the stacking means when the counter means reaches a preselected count.

17. A packaging apparatus according to claim 16 wherein said group conveyor means is of the endless type having pushers spaced apart therealong for advancing groups of stick confections along the stacking ramp.

18. A packaging apparatus according to claim 17 including transfer means movable crosswise of the stacking ramp and operated in timed relation with the group conveyor means for moving groups of articles off the stacking ramp.

19. A packaging apparatus according to claim 14 including means operative in the absence of a stick confection in a pocket on the stacking wheels when it is moved to the stacking ramp for preventing retrograde movement of the stick confections on the ramp.

20. A packaging apparatus according to claim 1 wherein said group forming means includes a stacking ramp and means for transferring pairs of stick confections from the outlet ends of the first and second conveyor means to the stacking ramp, group conveyor means having pushers spaced apart therealong for moving groups of articles along the stacking ramp, and means operative when a preselected number of pairs of stick confections have been transferred to the stacking ramp for operating said group conveyor means.

21. A packaging apparatus for assembling wrapped stick confections from a multi-lane packaging machine into groups with the stick ends of the wrapped stick confections overlapping comprising, endless type first and second conveyor means each having product pusher means at uniformly spaced locations therealong defining pockets between adjacent pushers for advancing stick confections crosswise of their length from a loading station sequentially past a checking station and an ejecting station to a stacking station, the first and second conveyor means having relatively parallel inlet portions, means for feeding wrapped stick confections from the multi-lane wrapping machine into the pockets on the first and second endless conveyor means with the stick ends in juxtaposition, product check means at the checking station, the first and second conveyor means having relatively parallel intermediate portions extending past the product check means with the product pushers on the intermediate portions of the first and second conveyor means arranged in transverse alignment to advance wrapped stick confections in opposed pairs to and away from the product check means, ejector means at the ejecting station actuatable to eject wrapped stick confections from both the first and second conveyor means, means operative when a defective pair of wrapped stick confections are advanced by a transversely aligned pair of product pushers to the product check means for operating the ejector means to eject the stick confections advanced by that pair of transversely aligned pair of product pushers when they advance past the ejecting station, the first and second conveyor means having outlet end portions extending from the ejecting station to the stacking station with the product pushers arranged in transverse alignment to advance wrapped stick confections in opposed pairs and with their stick ends overlapping to the stacking station, and group forming means at the stacking station for assembling opposed pairs of wrapped stick confections from the first and second conveyor means into groups comprising a plurality of pairs of wrapped stick confections.

* * * * *